US008016139B2

(12) United States Patent
Hanners et al.

(10) Patent No.: US 8,016,139 B2
(45) Date of Patent: Sep. 13, 2011

(54) GLIDE SYSTEM WITH ADJUSTABLE DIVIDERS AND MODULAR FLOOR MEMBERS

(75) Inventors: Kent Hanners, St. Charles, MO (US); Andrew J. Boron, Belleville, MO (US); Donald J. Miller, Belleville, IL (US); Gregg J. Crews, Wildwood, MO (US); Robert E. Kreutzer, Jr., Columbia, IL (US)

(73) Assignee: Presence from Innovation, LLC, St. Louis, MO (US)

( * ) Notice: Subject to any disclaimer, the term of this patent is extended or adjusted under 35 U.S.C. 154(b) by 304 days.

(21) Appl. No.: 12/418,468

(22) Filed: Apr. 3, 2009

(65) Prior Publication Data

US 2010/0252519 A1 Oct. 7, 2010

(51) Int. Cl.
*A47F 5/00* (2006.01)

(52) U.S. Cl. ..... 211/184; 211/59.2

(58) Field of Classification Search ..... 211/59.2, 211/59.3, 184, 183, 175, 135, 43; 312/61, 312/71; 108/60, 61; 206/529, 534, 561
See application file for complete search history.

(56) References Cited

U.S. PATENT DOCUMENTS

| | | | | | |
|---|---|---|---|---|---|
| 3,501,019 | A | * | 3/1970 | Armstrong et al. | 211/184 |
| 3,872,976 | A | * | 3/1975 | Moore et al. | 211/184 |
| 3,954,184 | A | | 5/1976 | Mendenhall | |
| 4,181,229 | A | * | 1/1980 | Moore | 211/184 |
| 4,460,096 | A | * | 7/1984 | Ricci | 211/184 |
| 4,478,337 | A | * | 10/1984 | Flum | 211/59.2 |
| 4,538,737 | A | * | 9/1985 | Delaney | 211/71.01 |
| 4,651,883 | A | | 3/1987 | Gullett et al. | |
| 4,712,694 | A | * | 12/1987 | Breslow | 211/184 |
| 4,768,661 | A | * | 9/1988 | Pfeifer | 211/184 |
| 4,785,945 | A | | 11/1988 | Rowse et al. | |
| 4,858,774 | A | * | 8/1989 | Winter et al. | 211/184 |
| 4,997,094 | A | * | 3/1991 | Spamer et al. | 211/153 |
| 5,199,584 | A | | 4/1993 | Fowler et al. | |
| 5,255,802 | A | | 10/1993 | Krinke et al. | |
| 5,265,738 | A | * | 11/1993 | Yablans et al. | 211/59.3 |
| 5,458,248 | A | * | 10/1995 | Alain | 211/175 |
| 5,624,042 | A | | 4/1997 | Flum et al. | |
| 5,634,564 | A | * | 6/1997 | Spamer et al. | 211/59.3 |
| 5,685,664 | A | * | 11/1997 | Parham et al. | 403/393 |
| 5,695,077 | A | | 12/1997 | Jay | |
| 5,709,158 | A | | 1/1998 | Wareheim | |
| 5,884,782 | A | * | 3/1999 | Dembicks | 211/70.6 |
| 5,904,256 | A | | 5/1999 | Jay | |
| 6,098,821 | A | * | 8/2000 | Dube et al. | 211/184 |
| 6,142,316 | A | * | 11/2000 | Harbour et al. | 211/59.2 |
| D450,726 | S | | 11/2001 | Menz | |

(Continued)

*Primary Examiner* — Jennifer E. Novosad
(74) *Attorney, Agent, or Firm* — Husch Blackwell LLP

(57) ABSTRACT

A variable shelf organizer glide system for merchandising products therefrom capable of being assembled to accommodate any shelf length and width and any product dimension including a plurality of cooperatively engageable adjustable floor members having a plurality of transverse projection members associated with each respective track rib, the transverse projection members extending laterally across only a portion of the respective longitudinal slots formed between adjacent track ribs, and a plurality of adjustable divider members, each divider member being selectively engageable with the transverse projection members to form any number of segregated product channels for arranging products therebetween. Each floor member includes frangible break-away portions for adjusting the overall length thereof, and each divider member includes a frangible break-away front product stop member as well as a plurality of frangible break-away rear portions for likewise controlling the overall length of each divider member.

52 Claims, 12 Drawing Sheets

U.S. PATENT DOCUMENTS

| | | | | |
|---|---|---|---|---|
| D459,738 | S | 7/2002 | Menz | |
| 6,419,100 | B1 | 7/2002 | Menz et al. | |
| 6,523,702 | B1 * | 2/2003 | Primiano et al. | 211/59.2 |
| 6,523,703 | B1 | 2/2003 | Robertson | |
| 6,615,995 | B2 * | 9/2003 | Primiano et al. | 211/59.2 |
| 6,637,604 | B1 | 10/2003 | Jay | |
| 6,874,646 | B2 | 4/2005 | Jay | |
| 6,955,269 | B2 | 10/2005 | Menz | |
| 6,962,260 | B2 | 11/2005 | Jay et al. | |
| 7,083,054 | B2 | 8/2006 | Squitieri | |
| 7,182,209 | B2 | 2/2007 | Squitieri | |
| 2003/0010737 | A1 * | 1/2003 | Lee | 211/184 |
| 2003/0132178 | A1 * | 7/2003 | Jay et al. | 211/59.2 |
| 2005/0133471 | A1 * | 6/2005 | Squitieri | 211/59.2 |
| 2007/0175844 | A1 | 8/2007 | Schneider | |
| 2010/0252519 | A1 * | 10/2010 | Hanners et al. | 211/184 |

* cited by examiner

GLIDE SYSTEM WITH ADJUSTABLE DIVIDERS AND MODULAR FLOOR MEMBERS

BACKGROUND OF INVENTION

The present invention relates generally to shelf organizers for use in a wide variety of product merchandising display units including refrigerated display coolers commonly employed by supermarkets, convenience stores, and other wholesale and retail outlets and, more particularly, to various embodiments of a universal floor/shelf organizer system which is capable of being assembled so as to accommodate any shelf length and width, and which includes divider members which can be selectively positioned and adjusted to produce product guide channels of varying width to accommodate products of varying sizes and shape. The present shelf organizers can be conveniently supported in a flat horizontal position or in an inclined position for gravity feeding products positioned thereon and represent a one-inventory solution to a particular user's specific needs and applications.

One of the problems typically associated with storing and displaying shelved products for sale to customers in a retail store setting is the inefficient use of available shelf space and the inability of the merchant to constantly provide an attractive arrangement of shelved products which are readily visible and easily accessible to the customer. Typically, articles of merchandise, especially products such as numerous bottled and canned soft drink products which are packaged in a wide variety of container sizes and shapes, are randomly distributed and stacked in segregated areas on a shelf or other display device in such a manner that the selection of a particular item, access to that particular item, and the removability of that item from the shelf or display device by the customer becomes, at times, difficult if not impossible. In the present day marketing of consumer products, it is important to maintain the display of products in a suitable and organized fashion.

As a result, a wide variety of display devices and shelf organizers have been designed and manufactured for use in merchandising shelved products to consumers, and such devices are commonly utilized by supermarkets, convenience stores, grocery outlets, fast food outlets, and a wide variety of other wholesale and retail stores to show and focus attention on the particular products displayed therein. Although various shelf organizer constructions are known and have been utilized to alleviate some of the aforementioned problems associated with merchandising shelved products to customers, the known devices generally have limitations in their ability to be compatible with shelves of varying width and length and, more importantly, they likewise have limitations in their ability to adjust the segregated product channels associated therewith to accommodate products of varying shapes and sizes so that a wider variety of different products may be merchandised from the same units.

SUMMARY OF INVENTION

The present invention relates to a glide system designed to be a variable shelf organizer for merchandising products, the present glide system being assembled to accommodate any shelf length and width, and any product dimension. The present invention includes a plurality of cooperatively engageable adjustable floor members having a plurality of spaced-apart runners or track ribs associated therewith for cooperatively receiving any one of a plurality of adjustable divider members, each divider member being selectively engageable with a plurality of spaced projections associated with each track rib so as to form any number of segregated product guide channels for arranging products therebetween. The width of each product guide channel is selectively adjustable by engaging the respective divider members forming such product guide channels with different track ribs or runners thereby varying the distance between any two adjacent divider members. Each product supporting floor member includes a joinder mechanism enabling a plurality of similarly constructed floor members to be cooperatively engaged in side-by-side relationship with one another so as to form an assembled organizer unit capable of accommodating any particular shelf width and length, and a plurality of break-away sections associated with the rear portion thereof such that each individual floor member can be reduced in overall length to accommodate a particular shelf length. Floor extension members are also provided to increase the overall floor length of each floor member if necessary.

More particularly, the present divider members each include an upstanding wall portion having a front product stop bumper and a rear product stop bumper associated therewith. The front product stop bumper is in the form of a break-off cone member and the rear product stop bumper includes a C-shaped channel portion for engaging the rear portion of each floor member. The front product stop bumper includes momentum arrestor means associated with the top portion of each respective cone member for stabilizing the forwardmost product container in each respective product channel and for preventing such product container from toppling over the front wall of the associated supporting floor member. The front product stop bumper also includes a hook member associated with each opposite side portion thereof for engaging a corresponding raised front wall member associated with each respective floor member. This raised front wall member includes a plurality of slots for receiving the respective hook members associated with the front product stop bumper. Engagement of the front and rear product stop bumpers with the front and rear portions of the associated floor member function to further hold such divider members in their operative position. Each divider member likewise includes a plurality of break-off sections for reducing the overall length of each divider member to accommodate the corresponding length of a particular floor member.

Each divider member further includes a main divider wall portion and a plurality of break-off portions, the main divider wall portion including a plurality of downwardly extending connector members which are specifically sized and shaped for engaging corresponding transverse projections associated with each of the respective track ribs or runners associated with each floor member. The forwardmost downwardly extending connection member includes an opening extending completely therethrough, this opening being sized and shaped so as to receive one of the transverse projection members associated with one of the upstanding track ribs. The intermediate downwardly extending connection members include a pocket or cavity for likewise receiving one of the transverse projection members associated with one of the track ribs. The rear portion of each divider member further includes a downwardly extending tab member associated with each break-off portion, these downwardly extending tab members extending between two adjacent track ribs but not engaging or coupling with any structure associated with a respective floor member. Each break-away rear portion of each divider member includes a weakened fracture line formed in the divider member during the manufacture thereof for easily severing the particular break-away portions from the remainder of the divider member. This break-away capability allows a user to again adjust the overall length of the divider member to correspond to the length of the particular floor member to which the divider member will be attached.

In addition, each divider member also includes a mechanism for reattaching the rear product stop bumper to any of the frangible divider portions or to the main divider wall structure once portions of the divider wall have been broken away for adjustment purposes. This reattachment feature includes a rear stop reattachment slot associated with each respective frangible portion and the main portion of the divider member as well as a rear stop reattachment hook member associated with the rear product stop bumper.

Each respective floor member includes a plurality of upstanding ribs or runners which extend substantially the full length of each respective member between a raised front wall stop member and the rear portion of each respective track rib. The respective track ribs are positioned in spaced apart relationship to each other and each individual rib includes a plurality of spaced apart transverse projections associated respectively therewith. Each projection is positioned between the top and bottom surfaces of its respective track rib and extends transversely or laterally across only a portion of the space existing between each respective pair of adjacent track ribs thereby forming a space between the terminal end portion of each respective transverse projection member and the track rib positioned adjacent thereto. Engagement of the recesses or pockets associated with the intermediate downwardly extending divider connection members and engagement of the opening associated with the front downwardly extending divider connection member is accomplished by positioning the divider connection members within a corresponding slot between two adjacent track ribs and thereafter sliding the divider member forward in the open spaces between the terminal end portions of a respective set of transverse projection members and the adjacent track rib such that one of the spaced apart transverse projection members is positioned in alignment with the opening associated with the front divider connection member and the remaining intermediate divider pockets or recesses are positioned adjacent to the other transverse projection members associated with a particular track rib. This positioning is achieved by moving the front transverse projection member sideways in a transverse or lateral direction relative to the divider member in order for the projection member to be received within the opening associated with the front divider connection member. The remaining transverse projection members are received within the respective pockets or recesses associated with the intermediate divider connection members and merely abut a wall portion of the pocket when the divider member is moved forward. This abutment prevents the divider member from further forward movement but it does not prevent sideward movement. Also, importantly, once the front transverse projection member is engaged with the opening associated with the front divider connection member, both forward and rearward movement of that particular divider member within the space between two adjacent track ribs is prohibited.

Removal of a particular divider member from engagement with a particular track member is accomplished by merely pushing the divider member sideways or transversely away from the terminal end portion of the respective transverse projections associated with the particular track rib so as to disengage each of said transversely extending projection members from the front opening and the intermediate pockets associated with the downwardly extending divider wall connection members. Even if the front product stop bumper and rear connection product stop bumper associated with a particular divider member are utilized and are engaged respectively with the front and rear portions of a particular floor member, such divider member can still be disengaged from the corresponding track projection members by merely pushing the divider member sideways. The divider member cannot be disengaged from the front projection member by simply moving the divider member rearwardly. Each attached divider member must first be moved sideways in order to remove the front projection member from the opening in the front divider connection member. Once this sideways movement is accomplished, the divider member can be disengaged from the track member by moving the divider member rearwardly and simply lifting it out of the floor member. If the divider member is moved sideways along the entire portion of its length housing the divider member connection members, rearward movement may be unnecessary and the divider member may be simply lifted out of the floor member while maintaining this sideward pressure.

The underside portion of each respective floor member includes a plurality of segregated compartments formed by the bottom surfaces of the track ribs, the side walls, the front and rear end walls, and the plurality of transverse beams associated with each particular floor member. In addition, at least one of the longitudinally extending track ribs associated with each track member is thickened as compared to other track ribs and extends downwardly such that its bottom surface lies in a plane substantially co-planar with the bottom surfaces of the side walls, the front and rear walls, and the transverse beams thereby defining a substantially uniform grid pattern having segregated compartments associated with the bottom portion thereof, each segregated compartment having a smooth, continuous ceiling surface formed by the bottom surfaces of the track ribs.

Each respective floor member further includes joinder means associated with the opposed side walls thereof for connecting respective floor members in side-by-side relationship to each other. These connection means facilitate joinder in a releasable manner such that the overall width of a particular floor member formed from any plurality of floor members can be adjusted to accommodate any shelf width. Floor extension members and associated joinder means are also provided to increase the length of any particular floor member to accommodate shelf lengths exceeding the standard length of the individual floor members.

Because of the construction of the floor members and divider members of the present glide system, once the present floor members are coupled together in side-by-side relationship to form an overall shelf floor, the individual divider members may be selectively positioned within any space or opening existing between adjacent track ribs, even the space or slot existing between two coupled floor members, each respective pair of divider members defining therebetween a product guide channel for supporting and guiding products positioned therebetween in parallel rows. This construction enables a merchant to easily segregate any or all of the floor members into a plurality of parallel guide channels for supporting and guiding products positioned therebetween, each guide channel being selectively adjustable to accommodate any product width.

DETAILED DESCRIPTION

Figure 1:
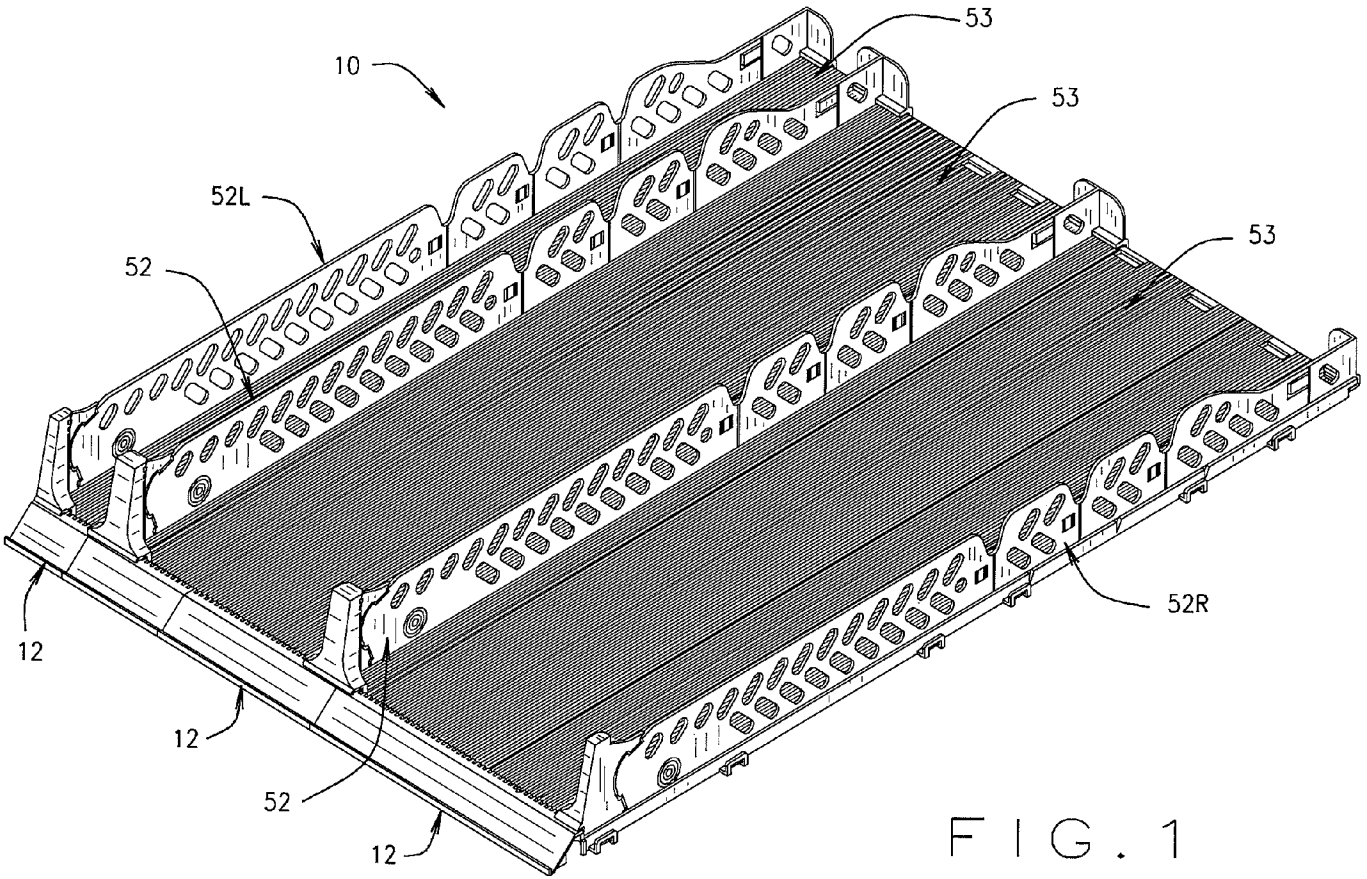
FIG. 1 is a perspective view of one embodiment of a shelf organizer glide system constructed and assembled according to the teachings of the present invention.

Referring to the drawings more particularly by reference numbers, wherein like numerals refer to like parts, the number 10 in FIG. 1 identifies a shelf organizer glide system constructed according to the teachings of the present invention. The glide system 10 includes a plurality of cooperatively engageable floor members or track members 12, a plurality of substantially identical removably attachable divider members including a left side divider member 52L, a right side divider member 52R, and a plurality of center divider members 52. The present system is designed to be a variable shelf organizer for merchandising products thereon, the floor members 12 being assembled to accommodate any shelf width and depth and the present divider members being assembled to accommodate any shelf depth and being adjustable to accommodate any product guide channel width 53 as will be hereinafter further explained. The floor members 12 can be formed in a wide variety of different widths as illustrated in FIG. 1, the structure of each such floor member 12 being substantially identical as will be in hereinafter further explained. Similarly, the overall structure of the divider members 52 is substantially identical except for the specific structure associated with the front and rear product stop members associated with each such divider member as again will be hereinafter further explained. It is recognized that the present shelf organizers can be utilized either on a flat supporting surface or on an inclined support surface for gravity feeding products therefrom.

Figure 2:
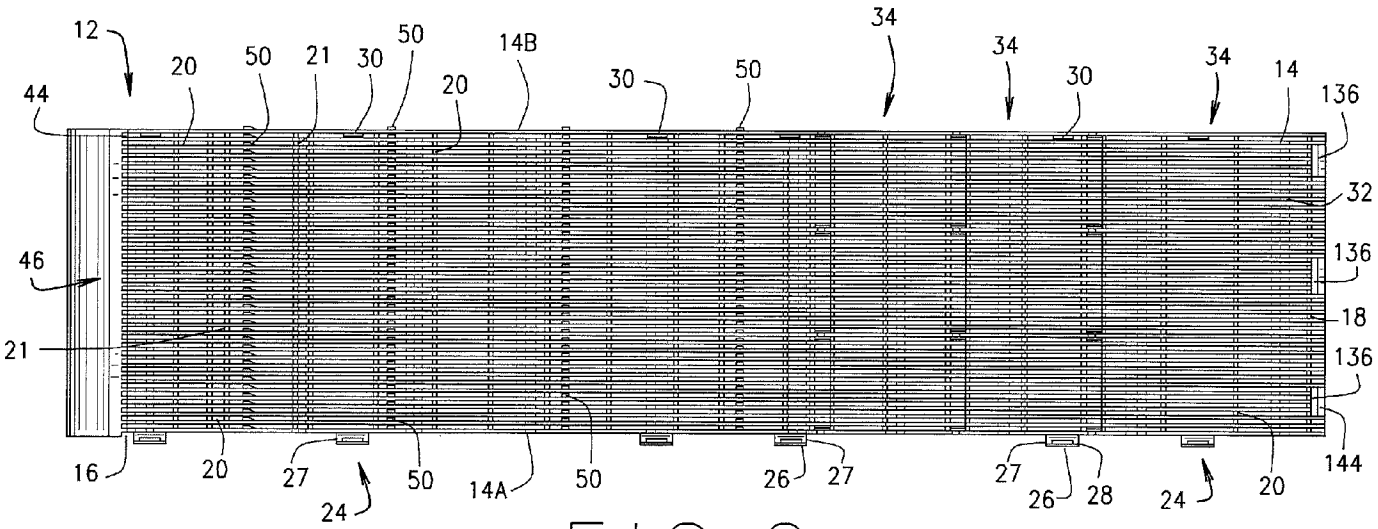
FIG. 2 is a top plan form view of one of the floor members of FIG. 1 constructed according to the teachings of the present invention.
Figure 3:
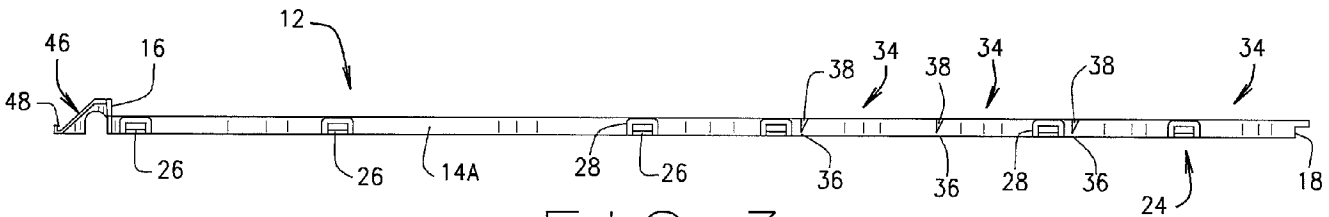
FIG. 3 is a right side elevational view of the floor member of FIG. 2.
Figure 4:
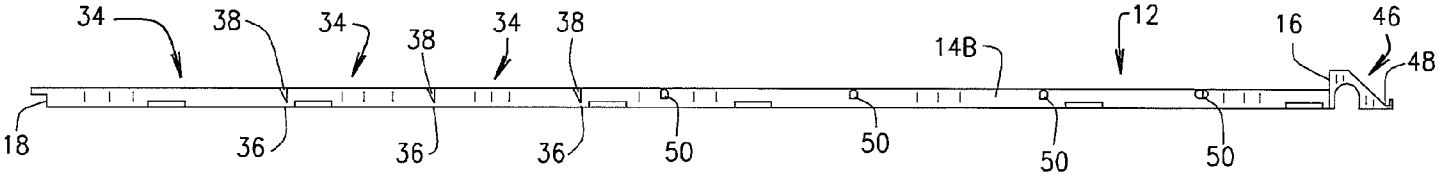
FIG. 4 is a left side elevational view of the floor member of FIG. 2.
Figure 5:
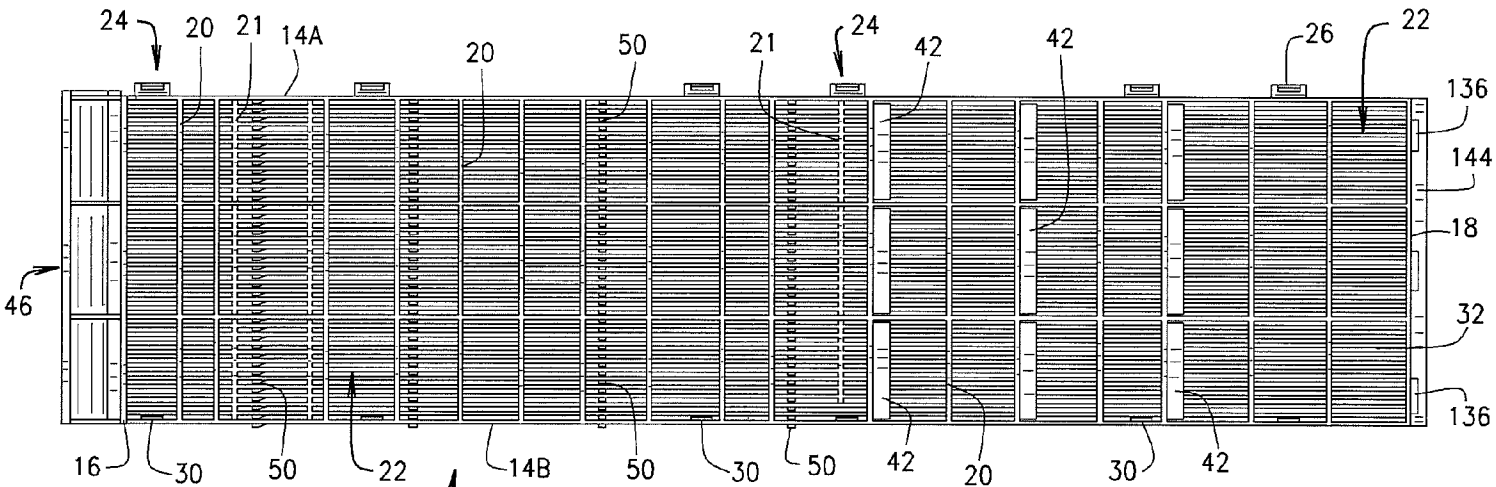
FIG. 5 is a bottom view of the floor member of FIG. 2.
Figure 5A:
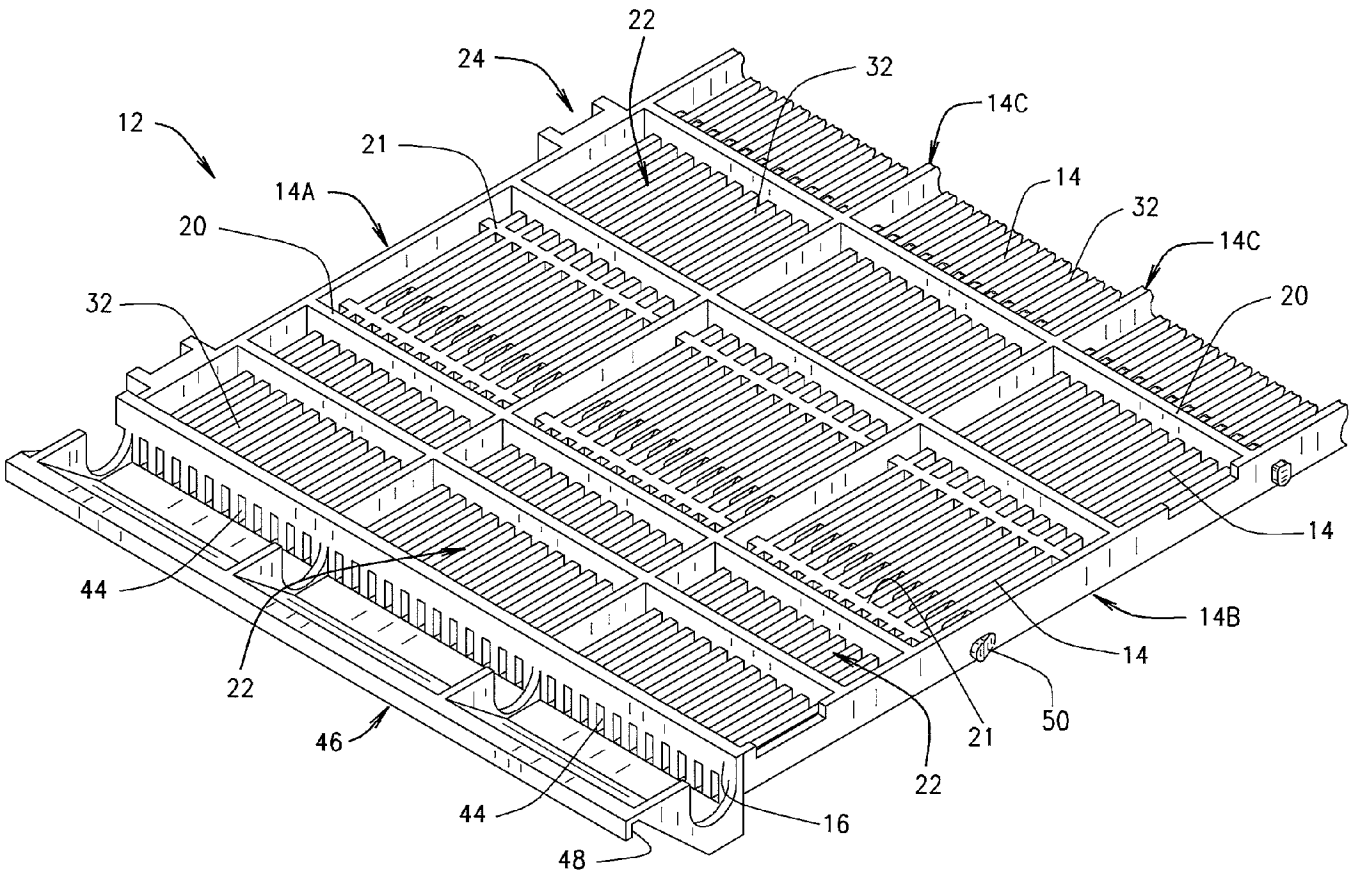
FIG. 5A is an enlarged partial view of a portion of the bottom structure of the floor member of FIG. 2.
Figure 6:
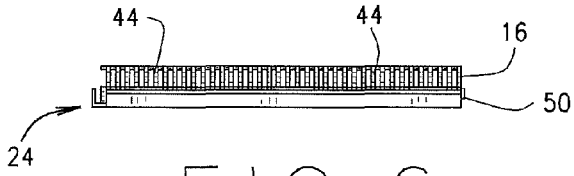
FIG. 6 is a rear elevational view of the floor member of FIG. 2.
Figure 7:
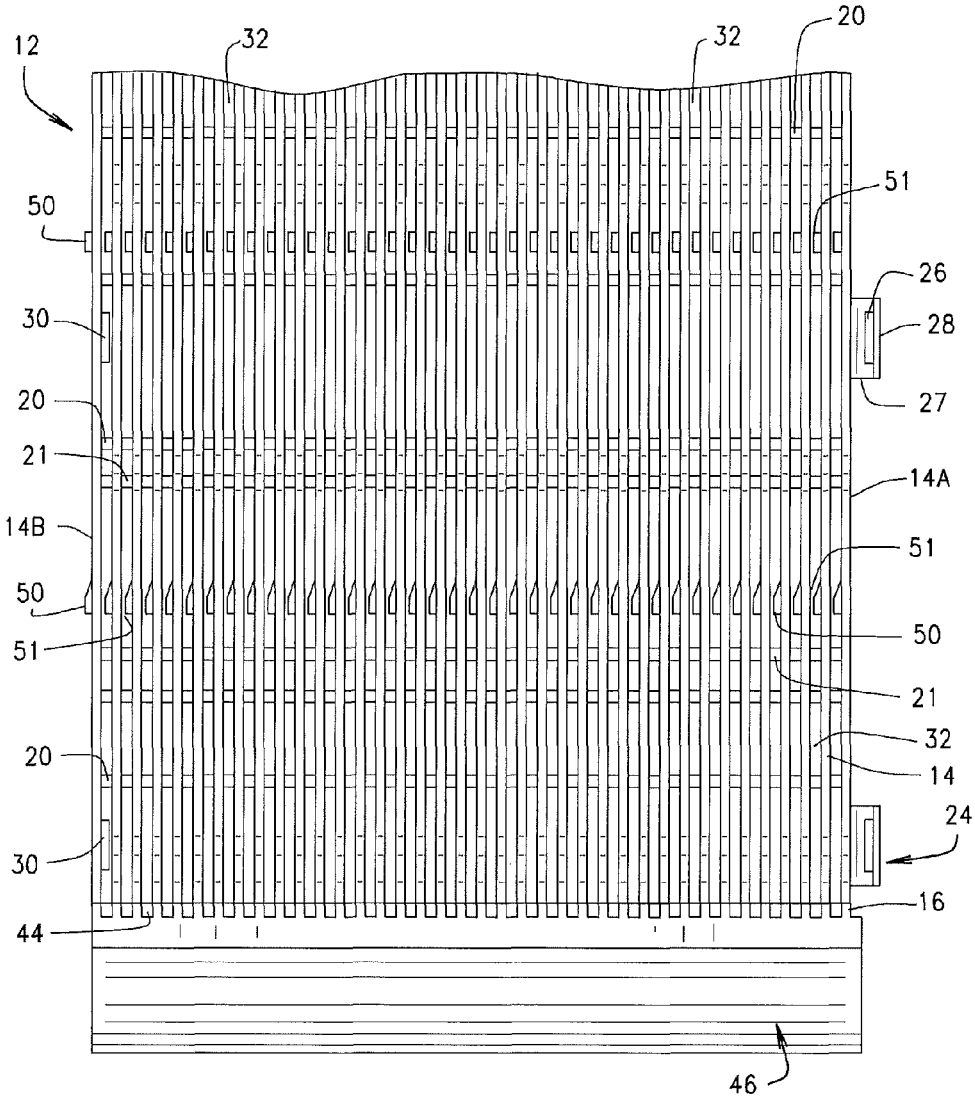
FIG. 7 is an enlarged partial top plan form view of a portion of the floor member of FIG. 2 showing the transverse projection members and the side-by-side joinder means in greater detail.

The floor members 12 are of an open grid-like construction as best illustrated in FIGS. 2-7. Each floor member 12 includes a plurality of spaced-apart upstanding track ribs or runners 14 which extend substantially the full length of each respective floor member between a raised front wall member 16 and a transverse extending rear support member 18 located at the rear portion of each respective floor member 12. A plurality of spaced apart transversely extending support members 20 are positioned between the front and rear wall portions 16 and 18 as best illustrated in FIGS. 2, 5 and 7 to provide additional support and stability to the overall floor member 12. In addition, the opposed outer upstanding ribs 14A and 14B can extend downwardly a greater distance than the intermediate rib members 14 as best shown in FIG. 5A so as to form the opposed side walls of each respective floor member 12. The side track rib members 14A and 14B also function to help form a plurality of segregated compartments 22 (FIG. 5A) formed by the bottom surfaces of the track ribs 14, the opposed side walls or side ribs 14A and 14B, the front and rear wall portions 16 and 18 and the plurality of transverse support members or beams 20 associated with each respective floor member 12. In addition, as best illustrated in FIG. 5A, at least one of the longitudinally extending upstanding ribs or runners such as track rib 14C is thickened as compared to other ribs or runners 14 and likewise extend downwardly such that its bottom surface lies in a plane substantially co-planar with the bottom surfaces of the opposed side track ribs 14A and 14B, the front and rear wall portions 16 and 18, and the transverse beams 20 thereby defining a substantially uniform grid pattern. This thickened track rib 14C likewise provides additional strength and stability to the overall floor member 12.

Each of the segregated compartments 22 can be identified as a basement chamber or basement compartment as best illustrated in FIG. 5A wherein the bottom surfaces of the intermediate track ribs 14 are co-planar with each other and form a smooth, continuous, uniform ceiling surface of such basement chamber within each segregated chamber, and the bottom surfaces of the respective side ribs 14A and 14B, the front and rear wall portions 16 and 18, the transverse beams 20, and thickened runners 14C all lie in the same plane thereby forming a uniform bottom-edge portion to each respective segregated compartment 22 and to each respective floor member 12. More particularly, the top surface associated with each transverse beam 20 lies in a plane between the top and bottom surfaces of each of the respective upstanding track ribs 14. Additional transverse beams 21 may be included to provide additional strength and stability to the overall floor members 12, such additional beams being positioned such that the top surface thereof lie in a plane between the top and bottom surfaces of the respective upstanding ribs 14, whereas the bottom surface of such additional beams all lie in a plane co-planar with the bottom surface of the respective upstanding ribs. This means that if such additional transverse beams are utilized, the bottom surfaces of such additional beams do not extend downwardly into the segregated basement compartments formed on the underside portion of each respective floor member.

Each product supporting floor member 12 includes a joinder mechanism enabling a plurality of similarly constructed floor members to be cooperatively engaged in side-by-side relationship with one another so as to form an assembled organizer unit capable of accommodating any particular shelf width. This is accomplished by providing cooperatively engageable means on the respective opposite side portions of the floor members 12 such that one side portion of one floor member 12 will interlock and engage with the opposite side portion of another similarly constructed floor member 12 positioned adjacent thereto. More particularly, in one embodiment, such cooperatively engageable means includes a plurality of spaced apart L-shaped connector members 24 each having an opening 26 associated therewith located on one side portion of the floor member 12 such as associated with opposed side track rib 14A, while the opposite side portion of the floor member 12 such as the opposite side track rib 14B includes a plurality of spaced apart transverse extending projection members 30 extending inwardly therefrom as best illustrated in FIGS. 2, 5 and 7. The L-shaped connector 26 includes a transverse extending base portion 27 as best illustrated in FIG. 7 and an upstanding flange portion 28 as best illustrated in FIG. 3. The upstanding flange portion 28 is spaced from the side track rib 14A and is sized and dimensioned so as to fit within the slot 32 formed between the outer track rib 14B and the intermediate track rib 14 positioned adjacent thereto. In this regard, the transverse extending projection member 30 is positioned between the top and bottom surfaces of the outer track rib 14B and extends transversely or laterally across only a portion of the space or slot 32 existing between track rib 14B and the adjacent track rib 14. This forms a space between the terminal end portion of each respective transverse projection member 30 and the track rib 14 positioned adjacent thereto. When the L-shaped connector member 24 associated with one floor member 12 is positioned within the slot 32 associated with an adjacent floor member 12 and the connector member 24 is aligned with the corresponding projection member 30 in side-by-side relationship, the flange portion 28 with its associated opening 26 will snap into and frictionally engage the transverse projection 30. This is made possible by the flexing of the outer upstanding track rib 14B and its adjacent track rib 14 forming the slot 32 as well as the space existing between the terminal end portion of the projection member 30 and the adjacent track rib 14. This is also accommodated by the shape and thickness of the flange portion 28 associated with connector member 24. When all of the joinder means 24 associated with one floor member 12 are engaged with all of the corresponding joinder means 30 associated with an adjacent floor member 12, the two floor members are interlocked with each other as illustrated in FIG. 1 and the top surfaces of all of the longitudinally extending track ribs 14 associated with both floor members 12 form a smooth, continuous supporting surface upon which products can be positioned. The present joinder means facilitates joinder in a releasable manner such that the overall width of a particular floor member formed from a plurality of floor members 12 can be adjusted to accommodate any shelf width. In this regard, any number of individual floor members 12, including floor members 12 having varying widths, can be positioned and joined in side-by-side relationship to each other to achieve any shelf width. It is also recognized and anticipated that other means for connecting the respective floor members 12 in side-by-side relationship are well known in the art and can be utilized with the present floor members 12.

Each respective floor member 12 likewise includes a plurality of break-away sections 34 associated with the rear portion thereof such that each individual floor member 12 can be reduced in overall length to accommodate a particular shelf length. Although break-away means are well known in the industry and typically include providing a line or plane of weakness extending transversely across the floor member or track member between the opposed side walls thereof, the present break-away means includes the use of offset lines of weakness lying in two different planes thereby providing additional support and stability to the respective break-away sections 34 while still enabling a user to easily disengage such break-away sections from the main floor member 12 to achieve the desired length. As best illustrated in FIGS. 2, 5 and 17-19, each break-away section 34 includes a line of weakness 36 formed by a slot or cutaway portion 38 formed in the respective outer side walls or side track ribs 14A and 14B as well as a similar slot or cutaway portion 38 formed in the at least one thickened track rib 14C. The slots or cutaway portions 38 function to sever the thickened track ribs 14A, 14B and 14C when appropriate force is applied thereto in a downward direction. A thin frangible line of weakness 36 is associated with each of these thickened track ribs.

Figure 17:
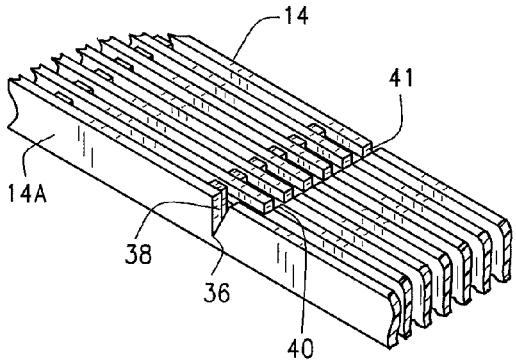
FIG. 17 is a partial perspective view of a portion of the floor member of FIG. 2 showing the offset lines of weakness associated with each frangible break-away portion of the floor member of FIG. 2.
Figure 18:
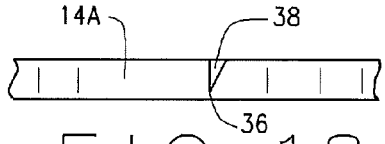
FIG. 18 is a partial side elevational view of the floor member of FIG. 2 showing one of the lines of weakness associated with the frangible break-away portions of the floor member of FIG. 2.
Figure 19:
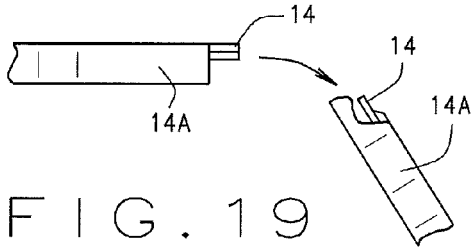
FIG. 19 is a partial side elevational view of a portion of the floor member of FIG. 2 showing separation of the frangible break-away portion from the remainder of the floor member.

In addition, a second line of weakness 40 as best seen in FIGS. 2 and 17 extends transversely across the remaining intermediate track ribs 14, this second line of weakness 40 being positioned in spaced apart relationship to the first line of weakness 36. In this particular embodiment, line of weakness 40 is positioned aft of line weakness 36. Also, the line of weakness 40 is similarly formed through the use of a slot or cutout portion 41 associated with the remaining intermediate track ribs 14. As best illustrated in FIGS. 2, 17 and 18, line of weakness 36 is formed towards the bottom portion of the thickened track ribs 14A, 14B and 14C, whereas line of weakness 40 is formed on a second plane located at the bottom portion of the intermediate track ribs 14, which bottom surfaces lie above the bottom surfaces of the thickened track ribs 14A, 14B and 14C. As a result, greater strength is afforded each of the frangible break-away sections 34 in the area of the lines of weakness 36 and 40 while supporting products thereon.

Any number of frangible break-away portions 34 can be associated with the rear portion of each respective floor member 12 and each such break away section can be of a different length. Once these frangible break-away sections are removed from a particular floor member 12, the break-away sections 34 cannot be reattached to the same floor member or to any other floor member 12 associated with the overall glide system 10. In this regard, as best illustrated in FIG. 5, the spaces between the adjacent intermediate track ribs 14 extending between the respective lines of weakness 36 and 40 and extending transversely between the thickened track ribs 14A, 14B and 14C include a solid transverse member 42 which lies in a plane substantially co-planar with the bottom surfaces of such intermediate track ribs 14 thereby providing still additional support and strength to the plurality of track ribs 14 extending beyond the adjacent transverse beam 20 once a particular frangible break-away section 34 has been removed from the remaining portion of the floor member 12. All of these features provide additional support and strength to the overall floor member 12 when any number of frangible break-away sections 34 have been removed therefrom, and when products are positioned adjacent such end portions.

The front wall stop member 16 extends above the top surface of the respective track ribs 14 as best illustrated in FIGS. 3, 4 and 6 and forms a stop mechanism for products moving along the track ribs towards the front of the floor member 12. The height of the raised front wall stop member 16 can vary depending upon the types of products to be merchandised therefrom and such raised front wall member includes a plurality of slots 44 as best illustrated in FIGS. 5A and 6 for receiving respective hook members 68 associated with the front product stop portion 58 of each divider member 52 as will be hereinafter further explained. In addition, the front wall 16 further includes a graphic panel support member 46 which includes a channel member 48 located adjacent the bottom portion thereof and extending along the full length thereof for receiving one end portion of a graphic panel which can contain product information, for example, product indicia or pricing information associated with the respective products to be merchandised on the overall glide system 10. The front face of the graphic panel support member 46 may be inclined as best illustrated in FIGS. 3 and 14-16.

Still further, the respective track ribs or runners 14 are arranged such that a longitudinal slot or opening 32 is formed between each respective pair of track ribs 14 as best illustrated in FIGS. 2, 5 and 7. Each respective track rib or runner likewise includes a plurality of spaced apart transverse projections 50 associated respectively therewith, each projection 50 being positioned between the top and bottom surfaces of each respective track rib 14 and each projection 50 extending transversely or laterally across only a portion of the space or slot 32 existing between each respective pair of adjacent ribs 14 thereby forming a space between the terminal end portion of each respective transverse projection member 50 and the rib or runner 14 positioned adjacent thereto. These projection members 50 are used to engage the connection members 80 and 84 associated with the respective divider members 52, 52L and 52R as will be hereinafter further explained. These projection members 50 are likewise associated with the main portion of each respective floor member 12, and are not necessarily associated with the frangible break-away sections 34.

Because of the materials and lubricants used in the construction of the track ribs 14, such track ribs reduce the friction between their upper surfaces and the products positioned thereon thereby improving the slidability of such products therealong. This is particularly important when the present floor members 12 are used in a gravity feed arrangement since products positioned thereon must be able to slide under the force of gravity towards the front portion of the gravity feed unit when the forwardmost products are removed therefrom. The construction of some embodiments of the track ribs 14 as well as the materials and lubricants used to improve the slidability of products positioned thereon are more fully disclosed and described in U.S. Pat. Nos. 4,801,025; 4,454,949; and 4,416,380, and are well known in the industry. It is also important that the spacing between the track ribs 14 be such as to accommodate and support any and all of the various products that are to be positioned thereon regardless of the shape or contour of their bottom walls. Since many articles of merchandise are packaged in containers having unique and unusual shapes, it is usually preferred to have the spacing between the track ribs 14 substantially uniform and relatively small across the width of the organizer unit 10 so as to accommodate and support products having many different bottom wall configurations. The spacing selected may be especially important for some products that have contoured bottom wall portions to properly support such products on the track ribs 14 to reduce the possibility that they will overturn. In this regard, each individual floor member 12 may include any plurality of track ribs 14 depending upon the spacing between each pair of ribs 14 so selected.

Each floor member 12 including all of its various components such as the track ribs 14, the front and rear wall portions 16 and 18, the transverse support beams 20, the joinder means 24 and 30, the graphic panel support member 46, and the transverse projections 50 is preferably of a one-piece unitary construction which can be excluded or injection molded from a wide variety of plastic and other materials. Other fabrication methods are likewise recognized and anticipated. Still further, although not required, silicone or other lubricants can be impregnated into the plastic material used to fabricate the track ribs or runners 14 to improve the slidability of products thereon. This impregnation substantially reduces the possibility that products stored thereon will jam or stick and not slide and it greatly enhances the reliability and effectiveness of the present glide system 10 when it is employed in a gravity feed system.

Figures 11, 12, 13:
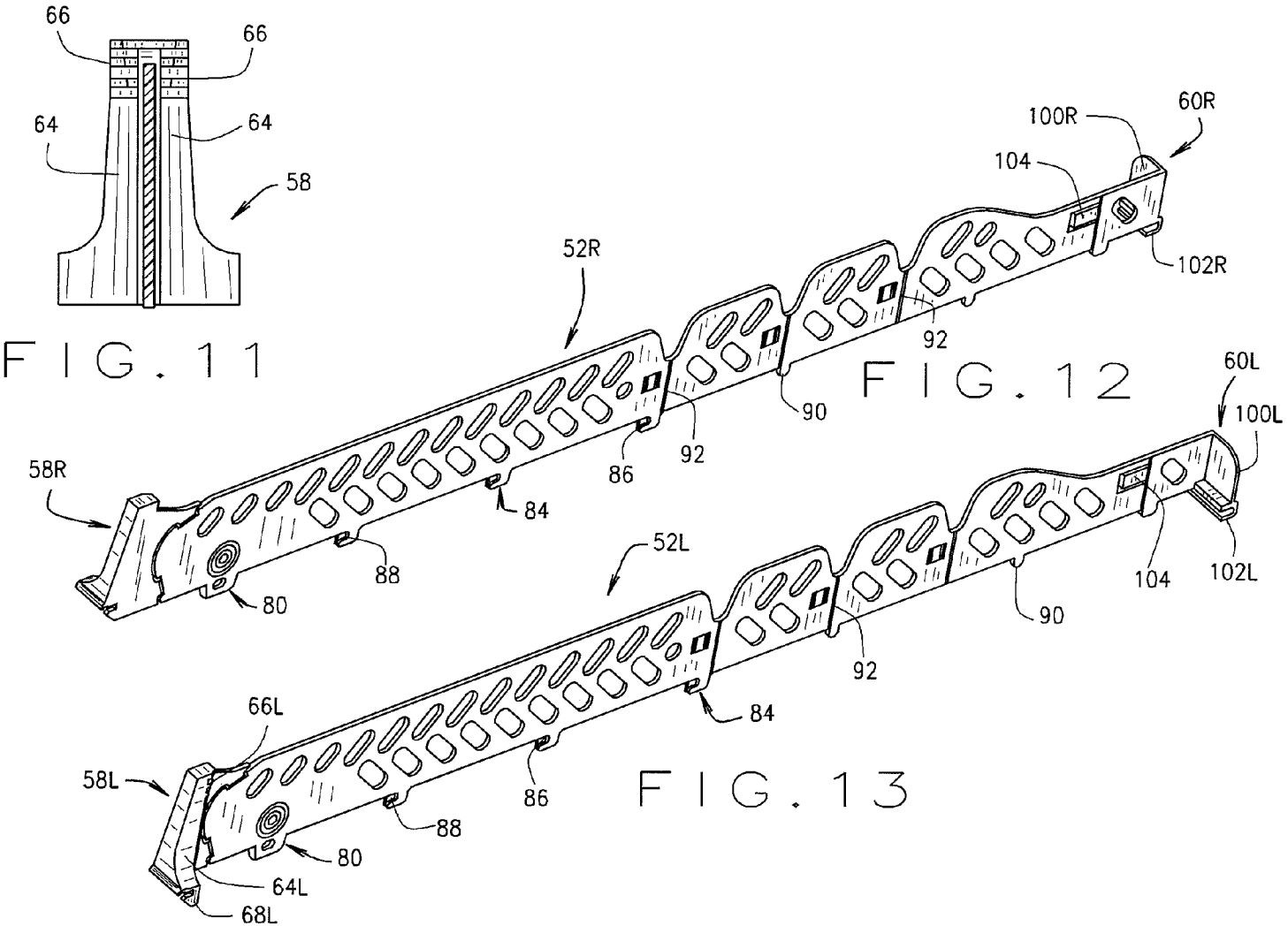
FIG. 11 is a cross-sectional view taken along line 11-11 of FIG. 9.
FIG. 12 is a perspective view of one embodiment of a right side divider member constructed according to the teachings of the present invention.
FIG. 13 is a perspective view of one embodiment of a left side divider member constructed according to the teachings of the present invention.

A plurality of upstanding divider members or partitions such as the divider members 52, 52L and 52R illustrated in FIGS. 8-16 are used in conjunction with the present glide system 10 in order to segregate products positioned on the member 10 into parallel rows. Divider member 52 illustrated in FIGS. 8-11 represents a center type divider member utilized at intermediate locations along the width of the glide system 10 whereas divider member 52L illustrated in FIG. 13 is a divider member specifically constructed for use adjacent the left side portion of the glide system 10 and divider member 52R illustrated in FIG. 12 is a divider member specifically constructed for use adjacent the right side portion of the glide system 10. Except for the construction of the front product stop member and the rear product stop member as will be hereinafter further explained, the construction of the divider members 52, 52L and 52R are substantially identical.

Each divider member 52, 52L and 52R further includes a plurality of downwardly extending connector members 80 and 84 associated with the main divider portion 54 which are specifically sized and shaped for engaging the transverse projections 50 associated with the respective track ribs 14 of each respective floor member 12. The connector members 80 and 84 are sized and shaped so as to be slidably receivable within the space or slot 32 formed by and between each respective pair of track ribs 14. Each divider member 52 can be selectively engaged with a plurality of spaced projections 50 associated with each track rib 14 so as to form any number of segregated product guide channels such as the guide channels 53 illustrated in FIG. 1 for arranging products therebetween. The divider member 52L is specifically designed, as will be hereinafter further explained, to be positioned within the slot 32 adjacent the left side portion of the present glide system 10 as illustrated in FIG. 1; divider member 52R is specifically designed to be positioned within the slot 32 adjacent the right side portion of the glide system 10 as illustrated in FIG. 1; and any plurality of intermediate center divider members 52 can be engaged with any slot 32 along the width of the glide system 10 to form any number of segregated product guide channels 53. The width of each product guide channel 53 is selectively adjustable by engaging the respective divider members 52, 52L and 52R forming such product guide channels with the appropriate slots 32 formed between respective pairs of track ribs 14 thereby varying the distance between any two adjacent divider members. Because of the present construction, the present divider members 52, 52L and 52R may be selectively positioned within any plurality of slots 32 associated with any plurality of floor members 12 forming the overall glide system 10 depending upon the size, shape and overall dimensions of the particular products positioned thereon, even the slot formed between adjacent track ribs 14A and 14B existing between two coupled floor members 12, each respective pair of divider members 14 defining therebetween a product guide channel 53 for supporting and guiding products positioned therebetween in parallel rows.

Figures 8, 9, 9A, 10:
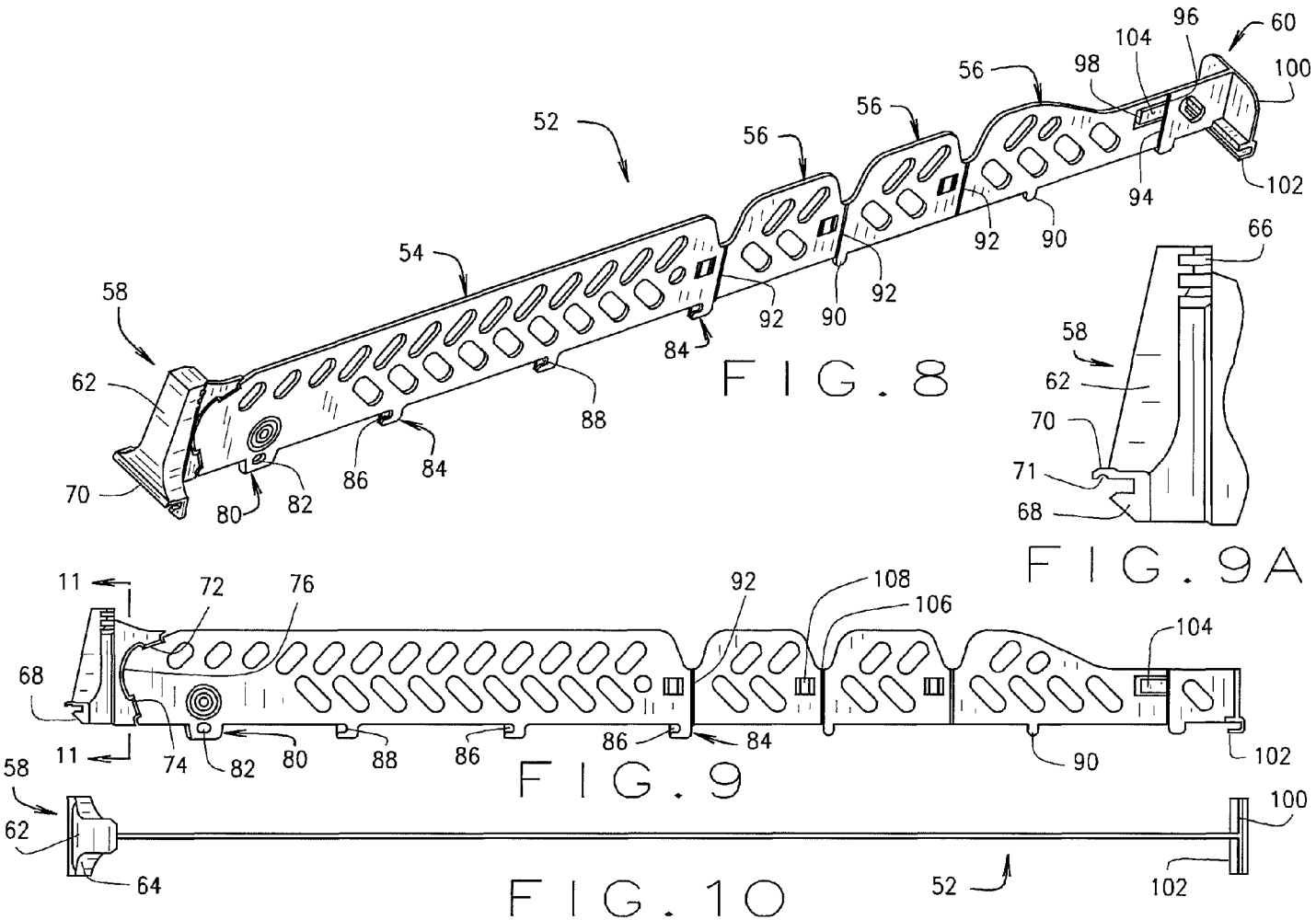
FIG. 8 is a perspective view of one embodiment of a center divider member constructed in accordance with the teachings of the present invention.
FIG. 9 is a side elevational view of the divider member of FIG. 8.
FIG. 9A is a fragmentary side elevational view of the front stop member associated with the divider member of FIGS. 8 and 9.
FIG. 10 is a top plan form view of the divider member of FIGS. 8 and 9.

As best illustrated in FIGS. 8-10, each respective divider member 52 includes a main divider portion 54, a plurality of break-away portions 56, a front product stop member 58 and a rear product stop member 60 associated with the last break-away portion 56. The plurality of break-away sections 56 enable a user to reduce the overall length of each divider member 52, 52L and 52R to accommodate the corresponding length of a particular floor member 12. The front product stop member 58 is in the form of a break-off cone type member 62 having a cone portion 64 associated with each opposite side portion thereof as best illustrated in FIGS. 9-11. Each front product cone portion 64 further includes momentum arrestor means 66 in the form of at least one projection member extending outwardly from the top portion of each respective cone portion 64 as best illustrated in FIGS. 9A and 11, the arrestor means 66 functioning to stabilize the forwardmost product container in each respective product channel as such forwardmost product container engages the front product stop member 58 as will be hereinafter further explained. The arrestor means 66 prevent such forwardmost product containers from toppling over the front product stop member 58 when such product containers engage the front stop member 58 during a gravity feed operation. The height of the stop member 62 depends upon the overall height and size of the product containers to be merchandised from the present glide system 10. The front stop member 62 further includes a pair of hook members 68 as best illustrated in FIG. 9A, each hook member 68 being associated with one side portion of the front member 62 for engaging a pair of slots 44 associated with the raised front wall 16 associated with each respective floor member 12. As best illustrated in FIG. 6, the raised front wall 16 includes a plurality of slots 44 for receiving the respective hook members 68 associated with the front member 62 of each divider member 52, 52L and 52R. The size and shape of each respective slot 44 is designed to frictionally engage each respective hook member 68 when the front product stop member 58 is engaged therewith. This positive engagement of the front product stop member 58 with the raised front wall stop member 16 associated with each floor member 12 provides further strength and stability to the engagement of each respective divider member with each respective floor member.

The pair of hook members 68 associated with the respective side portions of each respective front product member 62 are also positioned and located at the widest width of front member 62 along its bottom portion thereby further increasing the strength and stability of the front product stop member 58 when the forwardmost product container strikes the front stop member 58. In this regard, the arrestor means 66 strike the product container first before the bottom portion of the product container hits the bottom portion of the front member 62 adjacent the front wall 16 thereby further helping to prevent the product container from tipping or toppling over the front wall portion 16 associated with each floor member 12. As a result, the combination of the cone portions 64, the momentum arrestor means 66, and the hook members 68 all function and cooperate with each other when engaged with the front wall portion 16 of a particular floor member 12 to stabilize and contain the forwardmost product container in an upright position within a particular product channel 53 when the present glide system 10 is used in a gravity feed operation.

Figure 16:
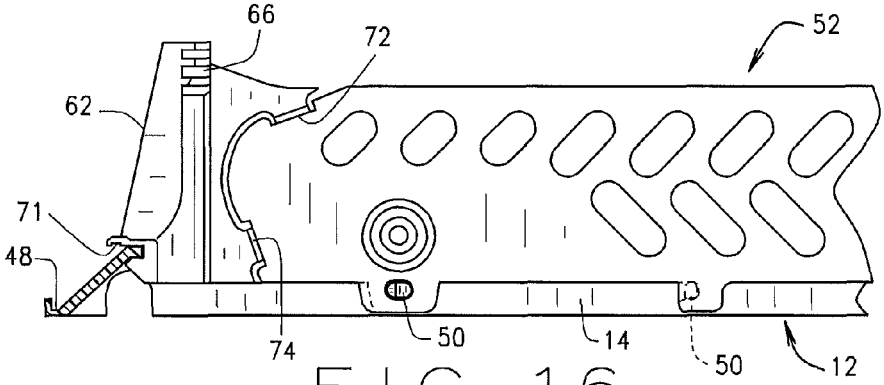

The front product member 62 likewise includes an overhanging lip portion 70 which forms a channel member 71 (FIG. 9A) adjacent the underside top portion thereof and extending along the full length of the bottom portion of member 62 for receiving the top edge portion of a graphic panel. When the front stop member 58 is engaged with the front wall 16 of a respective floor member 12 as best illustrated in FIG. 16, lip portion 70 extends over the top edge portion of the graphic panel support member 46 and the channel member 71 is exposed for receiving the top edge portion of a graphic/price panel positioned therewithin. The lip portion 70 and its associated channel member 71 (FIG. 16) function in cooperation with the channel member 48 associated with the bottom portion of the support member 46 to receive and hold any particular graphic/price panel inserted therebetween.

In addition, each front product stop member 58 is detachable from the main divider portion 54 by means of two separate lines of weakness 72 and 74 as best illustrated in FIGS. 9 and 14-16, these two separate lines of weakness being non-co-linear with each other as illustrated. A non-linear slot or gap 76 extends between the two non-co-linear lines of weakness 72 and 74 as illustrated in FIGS. 9 and 14-16. The positioning and location of the two non-co-linear lines of weakness 72 and 74 provide additional strength and stability to the front product stop member 58 in the needed direction, when such member is being used, yet it also enables the front stop member 58 to be easily broken off and removed by hand for certain applications when the front product stop member 58 is not necessary. The divider members 52, 52L and 52R function equally as well for segregating and guiding products within the respective product channels with or without the use of the front product stop member 58.

Figure 14:
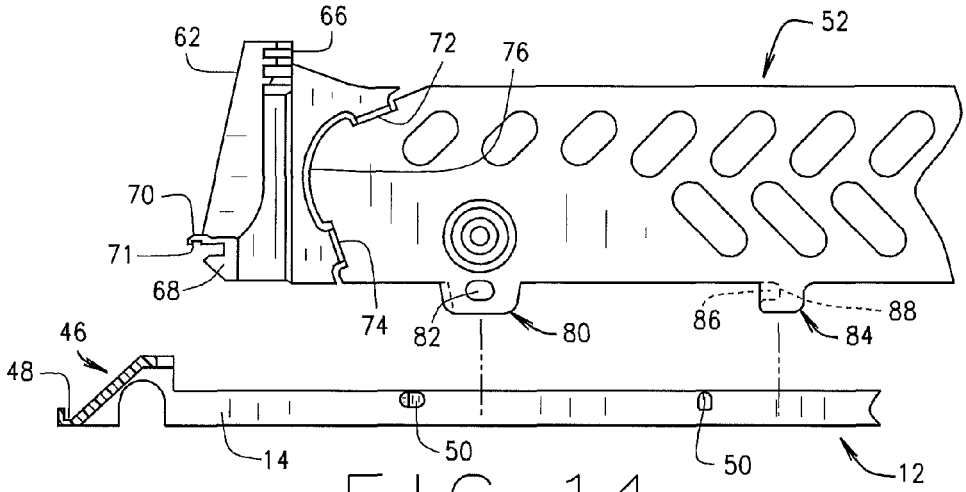
FIGS. 14-16 are side elevational views showing the attachment of a divider member to a floor member.
Figure 15:
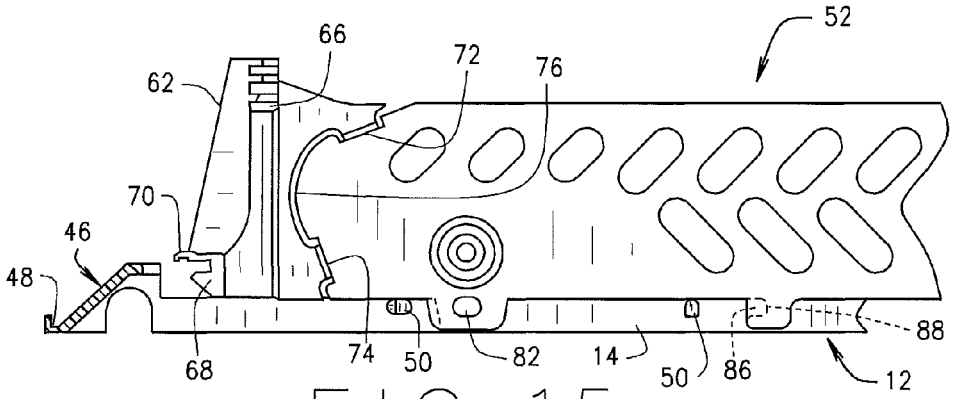

Each respective main divider portion 54 includes a forwardmost downwardly extending connection member 80 and a plurality of intermediate downwardly extending connection members 84. In one embodiment, the forwardmost downwardly extending connection member 80 includes an opening 82 extending partially or completely therethrough, the opening 82 being sized and shaped so as to receive the forwardmost projection member 50 associated with each of the track ribs 14. In contrast, the remaining intermediate downwardly extending connection members 84 each include a pocket or cavity 86 for likewise receiving and engaging one of the remaining transverse projection members 50 associated with each of the track ribs 14. When a particular divider member 14 is positioned within a particular slot 32 between a respective pair of track ribs 14 and moved in a forward direction as illustrated in FIGS. 14-16, the forwardmost projection member 50 engages the opening 82 associated with the forwardmost connection member 80 and extends into the opening thereby preventing the divider member from being moved either fore or aft, or in an upward or downward direction as will be hereinafter further explained. In similar fashion, when the divider member 52 is moved in a forward direction to engage the forwardmost projection member 50 with the opening 82, the remaining projection members 50 associated with the corresponding track rib 14 will slide into engagement with the recesses or pockets 86 associated with the intermediate connection members 84. In this regard, the recesses or pockets 86 do not extend all the way through the intermediate connection members 84 but, instead, such connection members include a wall portion 88 which forms the back portion of each respective recess or pocket 86. As a result, the recesses or pockets 86 restrict movement in the forward direction but do not restrict movement of the divider member 52 in a rearward direction.

Engagement of the recesses or pockets 86 associated with the intermediate connection members 84 and engagement of the opening 82 associated with the downwardly extending forwardmost connection member 80 associated with each divider member 52 is accomplished by positioning the divider connection members 80 and 84 within a corresponding slot 32 between two adjacent upstanding track ribs 14 and thereafter sliding the divider member forward in the open space 51 between the terminal end portion of a respective set of transverse projection members 50 and the adjacent track rib 14 such that the forwardmost transverse projection member 50 is positioned in alignment with the divider opening 82 and such that the remaining intermediate divider pockets or recesses 86 are positioned adjacent to the other transverse projection members 50 associated with a particular track rib 14. When in this particular position, the forwardmost projection member 50 must be moved sideways in a transverse or lateral direction relative to the track rib 14 in order for the projection member 50 to be received within the opening 82 associated with the front divider connection member 80. In this regard, the forwardmost transverse projection member 50 may be tapered in its longitudinal direction, that is, being thinner towards the rear of the corresponding floor member and becoming thicker as the projection member 50 progresses forward towards the front of the floor member as best illustrated in FIG. 7, thereby facilitating movement and engagement of the front connection member 80 and its associated opening 82 with the front projection member 50. This sliding movement of the divider member 52 forward in the slot 32 between the respective pair of track ribs 14 likewise causes the remaining transverse projection members 50 to be received within the respective pockets or recesses 86 associated with the intermediate divider connection members 84 thereby completing the engagement process. See, FIGS. 14-16. The intermediate projection members 50, when engaged with their respective pockets 86, merely abut the wall portion 86 and the rear portion of each respective pocket 86 thereby preventing any further forward movement of the divider member within the slot 32. This abutment prevents the divider member 52 from further forward movement but it does not prevent sideward movement, nor does it prevent rearward movement of the divider member relative to each respective pocket 86. As will be hereinafter further explained, the transverse projection members 50 are likewise only associated with the main divider portion 54 and are positioned and located in spaced apart relationship along the length of each respective track rib 14 so as to cooperatively engage the connector members 80 and 84 associated with each respective divider member 52.

Importantly, removal of a particular divider member 52 from engagement with a particular track rib 14 is accomplished by merely pushing the divider member sideways or transversely away from the terminal end portion of the respective transverse projection members 50 so as to disengage each of said transverse projection members 50 from the front opening 82 and intermediate pockets 86 associated with the connection members 80 and 84 respectively. Pushing the respective divider member 52 sideways away from the terminal end portion of the respective transverse projection members 50 allows the forwardmost projection member 50 to be disengaged with the opening 82 and, at that point in time, rearward movement of the divider member 52 will disengage the remaining intermediate projection members 50 from their respective connector pockets 86. Even if the front product stop member 58 is utilized with a particular divider member 52, such divider member can still be disengaged from the corresponding projection members 50 by merely pushing the divider member sideways and moving such divider member in a rearward direction to disengage the hook members 68 from the front wall portion 16 of the associated floor member 12. The divider members 52 cannot be disengaged from the front projection member 50 by simply moving the divider member rearwardly. The divider members have to be moved sideways in order to remove the front projection member 50 from the opening 82 in the forward connection member 80. Once this sideways movement is accomplished, the divider members 52 can be disengaged from the corresponding floor member 12 by simply moving the divider member rearwardly and lifting it out of the corresponding slot 32. All projection members 50 must be disengaged from the opening 82 and the corresponding pockets 86 before the divider member 52 can be lifted out of the corresponding track slot 32. If the divider member 52 is moved sideways or transversely away from the terminal end portion of the respective projection members 50 along the entire length of the main divider portion 52 so as to not only disengage the front projection member 50 from the corresponding opening 82, but also to disengage the remaining intermediate projection members 50 from their respective pockets 86, in such a situation, rearward movement of the divider member is not necessary and the divider member may be simply lifted out of the corresponding track slot 32 while maintaining this sideward force or movement.

The present divider members 52, 52L and 52R likewise include a plurality of frangible break-away portions 56 which allow a user to adjust the overall length of each divider member so as to correspond to the length of the particular floor member 12 to which the divider member will be attached. Each frangible break-away portion 56 includes a downwardly extending tab 90 which is likewise sized and dimensioned so as to extend between two adjacent track ribs 14 within a particular slot 32 when the divider member and its associated connector members 80 and 84 are positioned within the same slot 32. Unlike the connector members 80 and 84, the tabs 90 do not engage or couple with any structure associated with a respective floor member 12 but serve merely to locate the frangible divider portions 56 within the same slot 32 as the main divider portion 54. Once the connection members 80 and 84 associated with the particular divider member 52 are engaged with the projection members 50 as previously explained, the downwardly extending tabs 90 further function to keep the frangible divider portions 56 within the associated slot 32. Each frangible break-away divider portion 56 includes a line of weakness or weakened fracture line 92 as best illustrated in FIGS. 8, 9, 12 and 13, any one or group of frangible portions 56 being easily disengaged from the remaining portion of the divider member 52 by moving such frangible portion 56 back and forth along the appropriate fracture line 92 until such portion is removed thereby achieving the overall desired length.

Each divider member 52, 52L and 52R likewise includes a rear stop member 60 which is likewise attached to the rearwardmost frangible divider portion 56 along lines of weakness 94 and 96 as best illustrated in FIGS. 8, 9, 12 and 13. The fracture lines 94 and 96 are in linear alignment with each other and are separated by the space or opening 98 associated with the last frangible portion 56. The rear product stop member 60 includes a transverse member 100 which is positioned substantially perpendicular to the divider member 52 and extends into the product channels 53 formed on either side of the divider member 52 along the rear edge portion of the glide system 10 as illustrated in FIG. 1. The transverse member 100 functions as a partial rear wall structure which extends into each product channel 53 thereby restricting product containers from exiting the rear of the glide system 10. In addition, the transverse member 100 likewise includes a C-shaped channel 102 extending along the entire length of its bottom surface as best illustrated in FIG. 8, the C-shaped channel 102 being positioned, sized and located so as to engage the rear portion of each respective floor member 12. When the rear stop member 60 is utilized in association with a particular floor member 12, engagement of the C-shaped channel 102 with the rear portion of a particular floor member 12 adds further stability to the engagement of the particular divider member 52 within a particular track slot 32 and functions to further hold such divider member in its operative position. Engagement and disengagement of a particular divider member 52 with the rear stop member 60 attached thereto can be easily accomplished as previously explained and use of the rear stop member 60 does not interfere with or otherwise hinder such attachment and removal of the divider member 52.

Figure 23:
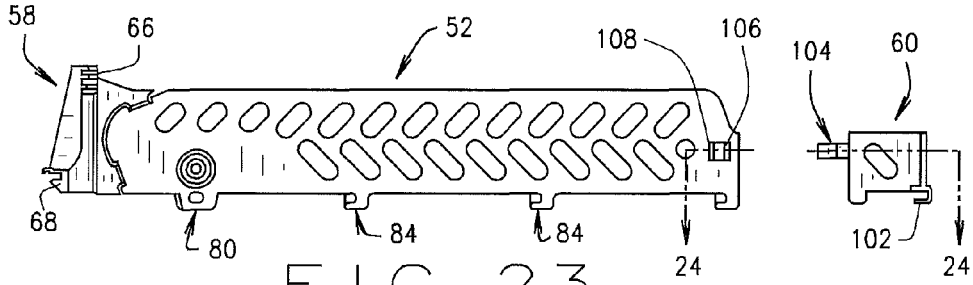
FIG. 23 is an exploded side elevational view of the divider member of FIGS. 8 and 9 showing the rear stop member removed therefrom.
Figure 24:
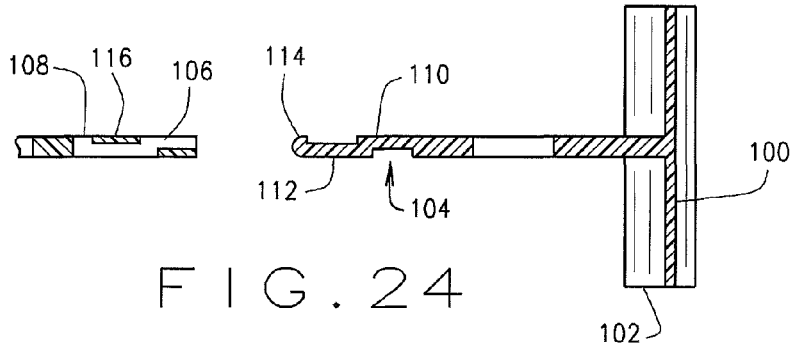
FIG. 24 is an exploded cross-sectional view taken along line 24-24 of FIG. 23 showing the structure of the rear stop reattachment hook member and the corresponding reattachment slots associated with the remaining portion of the divider member.
Figure 25:
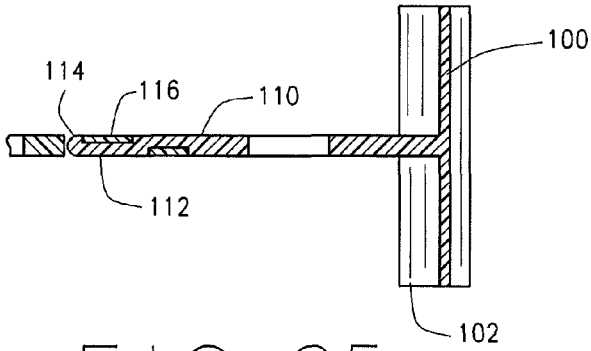
FIG. 25 is a cross-sectional view similar to FIG. 24 showing the rear stop member reattached to the remainder of the divider member.

If the rearwardmost frangible divider portion 56 is removed from a particular divider member 52, the rear stop member 60 can likewise be severed along lines of weakness 94 and 96 from the rearwardmost frangible divider portion 56 and such rear stop member 60 can be reattached to any of the remaining frangible divider portions 56 or to the main divider portion 54 once such frangible divider portions 56 have been broken away for adjustment purposes. In this regard, the rear stop member 60 includes a reattachment hook member 104 which is shaped and configured for engagement with a pair of spaced apart slots or openings 106 and 108 associated with the respective end portions of each frangible divider portion 56 as well as with the end portion of the main divider portion 54 as best illustrated in FIGS. 23-25. In this regard, the reattachment hook member 104 includes offset portions 110 and 112 (FIG. 24) as well as a projection portion 114 (FIG. 24) associated with the terminal end portion of offset portion 112. When the rear stop member 60 is severed from its associated frangible divider portion 56 as illustrated in FIG. 23, the reattachment hook member 102 can be inserted within the appropriate remaining slot 106 and maneuvered such that the projection 114 associated with offset portion 112 is inserted within the slot 108 (FIG. 25). When in this configuration, the rear stop member 60 is in alignment with the remaining portion of the divider member 52 and the offset portion 112 lies flush with the divider wall portion 116 which extends between the reattachment slots 106 and 108 as illustrated in FIG. 25. When in this configuration, the rear stop member 60 can be positioned within any track slot 32 associated with any floor member 12 and the C-shaped channel 102 can be attached to the rear portion of the particular floor member 12 as previously explained. It is recognized and anticipated that other attachment mechanisms for reattaching the rear product stop member 60 to any of the frangible divider portions 56 or to the main divider portion 54 can be utilized. This reattachment feature enables a user to use the rear stop member in all possible configurations of each of the divider members 52, 52L and 52R.

FIGS. 12 and 13 illustrate the right and left side divider members 52R and 52L respectively. Divider members 52L and 52R are substantially identical in construction to the center divider member 52 discussed above and each differs therefrom only with respect to the shape of the front and rear product stop members 58L, 58R, 60L and 60R. As clearly illustrated in FIGS. 12 and 13, the front product stop members 58L and 58R include only one half portion of the respective members 62 and 100, the front cone portions 64L and 64R and their respective arrestor means 66L and 66R being positioned and located on that side of the respective divider members 52L and 52R which face inward towards the glide system 10. In similar fashion, the rear transverse members 100L and 100R face inwardly towards the interior portion of the glide system 10. In all other respects the divider members 52, 52L and 52R are similar in construction, function and operation including attaching and removing such divider members to the respective floor members 12. The divider member 52L being specifically designed for positioning within the track slot 32 located adjacent the left side portion of the glide system 10 illustrated in FIG. 1 and the divider member 52R being specifically designed for insertion within the track slot 32 positioned adjacent the right side portion of the glide system 10 illustrated in FIG. 1.

Figure 20:
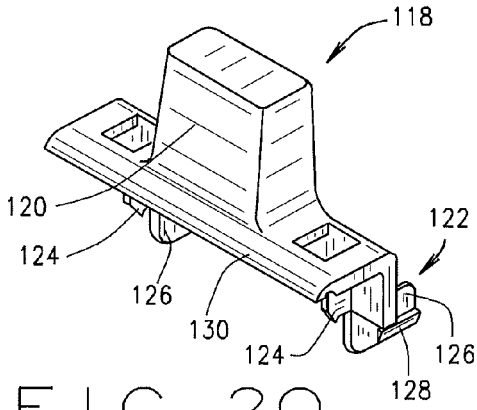
FIG. 20 is a perspective view of another embodiment of a front wall stop member constructed according to the teachings of the present invention.
Figure 21:
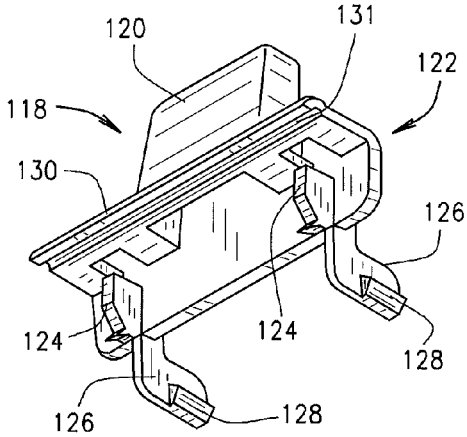
FIG. 21 is a perspective view of the front wall stop member of FIG. 20 looking from the bottom thereof.
Figure 22:
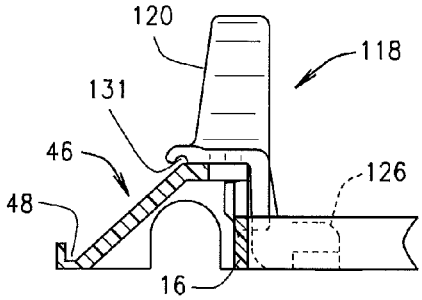
FIG. 22 is a partial side elevational view of the front wall stop member of FIG. 20 attached in operative position with the front wall of the floor member of FIG. 2.

FIGS. 20-22 illustrate the construction of another embodiment of a front wall stop member 118 which can be used in conjunction with the present glide system 10. In those applications where the present glide system 10 transitions from single serve product containers such as bottles and cans of soft drink products to multi-pack arrangements, or where the width of the product to be merchandised within any particular product channel 53 requires additional front stop means, stop member 118 can be utilized. Stop member 118 includes an upright stop portion 120 mounted on or integrally formed with a substantially L-shaped base portion 122 as best illustrated in FIGS. 20-22. The stop portion 120 as well as base portion 122 can be of any height and width depending upon the particular application. Base portion 122 likewise includes a pair of spaced apart hook members 124, similar to the hook members 68 associated with the front stop member 58 of the divider members 52, which extend towards the front of the member 118 for engagement with the slots 44 associated with the front wall portion 16 of each respective floor member 12. The stop member 118 also includes a pair of spaced apart hook members 126 which are positioned and located for engagement with a corresponding pair of track slots 32 associated with the floor members 12. The hook members 126 extend rearwardly towards the rear of the member 118 and each hook member 126 includes a flared flange portion 128 as best illustrated in FIGS. 20-22, the flared flange portion 128 being slightly wider in overall dimension as compared to the width of the respective track slots 32. The flared flange portions 128 are designed to flex the pair of track ribs 14 associated with the particular slot 32 into which they are inserted, each hook member 126 extending downwardly a sufficient distance such that the upper edge portion of each of the respective flange portions 128 will engage the underside portion of the respective pair of track ribs 14 when the hook members 126 are inserted and positioned therebetween. Once the hook members 126 are positioned within the corresponding slots 32 and the flared flange portions 128 are seated against the underside portion of the respective track ribs 14, the front product stop member 118 can be moved forward within the engaged track slots 32 such that the hook members 124 will engage the front wall portion 16 of that particular floor member 12 as previously explained with respect to hook members 68. The hook members 124 and 126 are located on two different planes as best illustrated in FIGS. 20-22 and engagement of hook members 126 with the track ribs 14 provided additional leverage for stopping product containers and/or multi-pack arrangements when such items hit the upright stop portion 120 in a gravity feed operation.

Base portion 122 likewise includes an overhanging lip portion 130, similar to the overhanging lip portion 70 associated with the front wall stop member 58 of each divider member 52, which forms a channel member 131 adjacent the underside top portion thereof similar to channel member 71 for likewise receiving and capturing the top edge portion of any graphic/price panel positioned on the panel support member 46. In certain applications, when transitioning from single product container servings to multi-pack servings, typically the front product stop member such as stop member 58 will be removed from the divider member 52 and the stop member 118 will be positioned within that particular product channel 53. Other uses and applications of the front stop member 118 are likewise envisioned and anticipated including using more than one stop member 118 within any particular product channel 53 depending upon the overall width thereof, and using the stop member 118 in conjunction with the front stop members 58.

Figure 28:
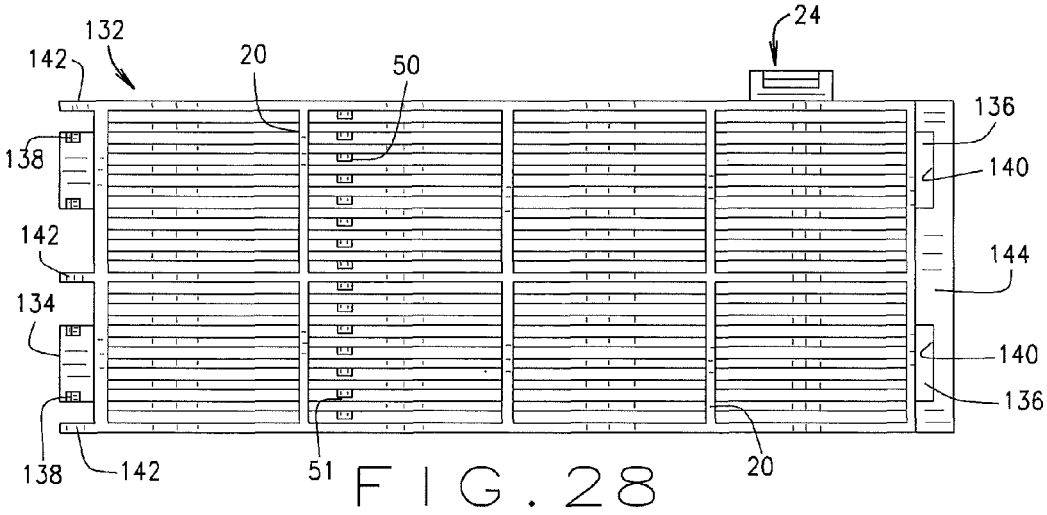
FIG. 28 is a bottom view of the floor extension member of FIG. 26.
Figure 29:
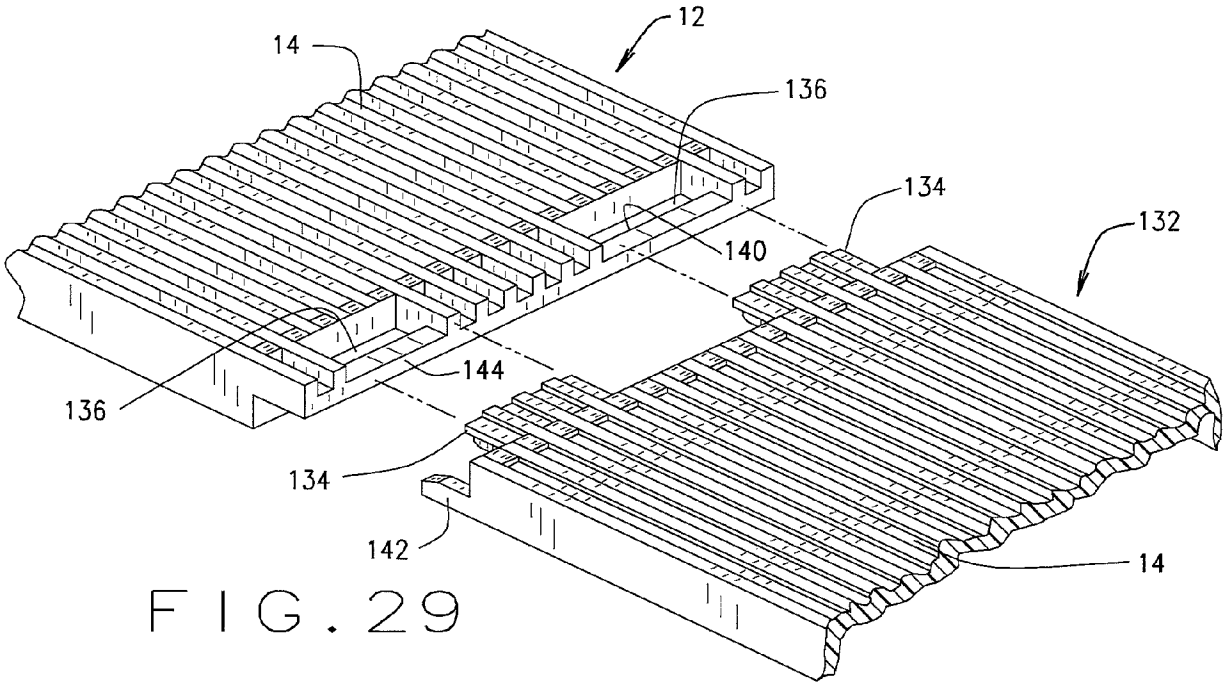
FIG. 29 is a partial exploded perspective view of the floor extension member of FIG. 26 preparatory to attachment to the floor member of FIG. 2.
Figure 30:
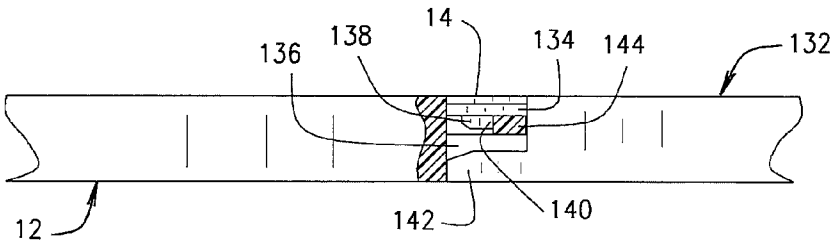
FIG. 30 is a partial side cut-away view of the floor extension member of FIG. 26 engaged with the floor member of FIG. 2.

Still further, FIGS. 26-30 represent a separate floor length extension element or member 132 which can be utilized with the present glide system 10 (FIG. 1) to adjust and increase the overall length of a particular floor member 12 and glide system 10 to accommodate a particular shelf length. In this particular scenario, none of the break-away sections 34 associated with any plurality of floor members 12 comprising a particular glide system 10 would be severed from the respective floor members but instead, additional extension members 132 would be coupled to the rear end portions of the respective floor members 12 to achieve the increased length. In this regard, each floor extension member 132 includes at least a pair of connection members 134 positioned and located so as to engage a corresponding pair of openings 136 associated with the rear end portion of each respective floor member 12 as best illustrated in FIGS. 29 and 30. Each connection member 132 includes at least one downwardly extending projection 138 (FIGS. 27, 28 and 30) which is sized and shaped to fit within the openings 136 and abut the rear surface 140 of the transverse member 144 forming the rear end portion of each respective floor member 12 (FIGS. 29 and 30) thereby preventing the extension member 132 from being disengaged from the floor member 12. In addition, each floor extension member 132 likewise includes a plurality of fingers or projections 142 (FIGS. 26-30) which are designed to extend under the transverse member 144 so as to provide additional strength and stability to the extension member 132 when coupled to floor member 12. When so coupled, the connection members 134 extend across the top portion of the transverse member 144 in alignment with the openings 136 whereas the fingers or projections 142 extend across the bottom portion of the transverse member 144 at a plurality of spaced locations therealong as illustrated in FIGS. 29 and 30. In one embodiment, the fingers or projection members 142 can coincide with the thickened track ribs 14A, 14B and 14C as previously explained. This sandwiching effect between the coupling members 134, 142 and 144 provides sufficient stability at the joinder intersection between the extension member 132 and the corresponding floor member 12 to support products positioned thereover in a particular application. In all other respects the floor extension member 132 is constructed substantially similar to the respective floor members 12 including the construction of the various track ribs 14, the side connection means 24 and 30, the transverse beams 20, and construction of the underside basement portion of each respective floor member. Still further, the connection members 134 likewise include track ribs 14 (FIG. 26) and the space between the respective openings 136 at the rear end portion of each respective floor member 12 include similar track ribs 14 (FIG. 29) such that, when engaged, the floor member 12 and the extension member 132 will provide substantially uniform and continuous track ribs 14 for movement of products thereon. In addition, the rear end portion of each respective extension member 132 likewise includes the transverse member 144 and the associated openings 136 such that additional extension members can be engaged therewith to even further increase the overall length of a particular floor member 12 if so desired. Any plurality of additional extension members 132 can be coupled together to achieve any desired shelf length.

Figure 26:
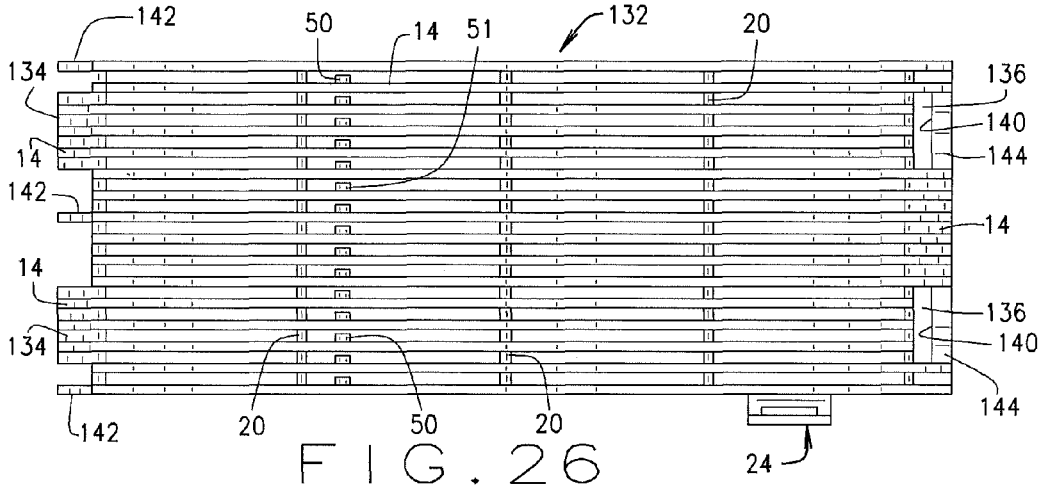
FIG. 26 is a top plan form view of a floor extension member constructed according to the teachings of the present invention.
Figure 27:
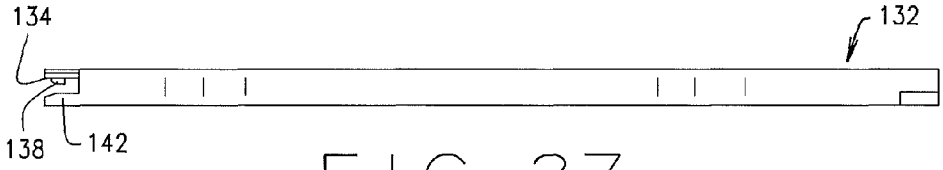
FIG. 27 is a side elevational view of the floor extension member of FIG. 26.

It is recognized and anticipated that when the floor extension members 132 are utilized, additional divider members may be necessary for attachment to the extension members 132 in order to maintain the integrity of segregated product channels 53 at the rear of the overall glide system 10. In this regard, each respective extension member 132 may include at least one projection member 50 associated with each respective track rib 14 as illustrated in FIGS. 26 and 28 for attaching similarly constructed divider members to the respective extension members 132. In this regard, the divider members 52, 52L and 52R can be fabricated to the appropriate length for the longer glide system 10 including use of the additional extension members 132. In this case, the divider members will be substantially identical in construction to divider members 52, 52L and 52R except that they will be of appropriate longer length. In other cases, a shorter divider member can be fabricated to accommodate use of one or more extension members 132. In this scenario, the shortened divider member could have the same height and geometry as the rear portion of the main divider portion 54 including at least one connection member 80 and/or 84; it could have the same height and geometry as the existing break-away divider sections 56 including at least one connection member 80 and/or 84; or it could have the same height and geometry of the existing divider break-away sections 56 including a reattachment hook member similar to hook member 104 associated with the front portion thereof for engaging the slots 106 and 108 associated with the respective rear end portions of each frangible divider portion 56 as previously explained. In this situation, the rear stop member 60 would be severed from the particular divider member 52 and the divider extension member would be attached thereto similar to attachment of the rear stop member 60 to any one of the frangible divider portions 56 or to the main divider portion 54 as previously explained. Still other methods for attaching any additional divider extender members can likewise be used. In this embodiment, the additional divider extender, member would function in the same manner as the removal and reattachment of the rear stop member 60 as previously explained.

It is also recognized and anticipated that the connection member 80 can be positioned and located anywhere along the length of the main divider portion 54 and that the connection member 80 can be interchanged with any connection member 84 without departing from the spirit and scope of the present invention. In other words, connection member 80 and its associated opening 82 can be located at any intermediate location along main divider portion 54, or it can be located towards the end portion thereof. Similarly, any one of the connection members 84 can be located at the forwardmost divider position. Still further, as previously explained, the opening 82 can extend completely through connection member 80, or opening 82 can extend only partially through such connection member thereby forming a cavity for receiving a corresponding transverse projection member 50 therewithin. In this particular embodiment, the cavity forming opening 82 should be of sufficient depth so as to prohibit movement of the divider member in a fore, aft, up or down direction once the projection member 50 is received therewithin. This cavity arrangement for opening 82 differs from the recesses or pockets 86 in that the recesses or pockets 86 include an open end portion for allowing any one of the transverse projection members 50 to be slidably received therewithin. Although the recesses or pockets 86 restrict forward movement as well as up and down movement, such pockets or recesses do not restrict movement of the divider member in a rearward or aft direction. Still further, once a particular divider member 52 is engaged with a particular floor member 12, the engagement of the connection members 80 and 84 with the plurality of transverse projection members 50 also further strengthens the floor structure and helps to reduce bowing or bending when products are position thereon.

It is also recognized and anticipated that the bottom surfaces of the intermediate track ribs 14 forming the ceiling associated with each segregated compartment 22 could likewise include a solid sheet member or floor member covering the same. In this embodiment, although the longitudinal slots 32 would still extend between two adjacent track ribs 14, additional spaced apart slots associated with such additional floor member may be necessary in order to allow the downwardly extending connector members 80 and 84 associated with each of the plurality of divider members 52 to extend below the bottom surface of each respective track rib for engagement with the respective transverse projection members 50. The use of such additional staggered or spaced apart slots in such additional floor member will depend upon the depth or downwardly extending distance associated with the intermediate track ribs 14.

It is important to note that the present glide system 10 is adaptable for use with all known, existing display units including equipment which utilize an open-grid type shelf structure. Such open-grid type shelf structures are commonly utilized in refrigerated display coolers and other types of cold vaults commonly found in supermarkets, convenience stores, and a wide variety of other wholesale and retail stores. When used in conjunction with such open-grid type shelf members, the present shelf organizers provide a stable, flat floor structure capable of holding and accommodating a wide variety of products including products packaged in containers having unique and unusual shapes associated with their bottom wall surfaces. In this regard, the present shelf organizers are adaptable for use with any type of shelf support structure or framework so long as sufficient framework exists to provide adequate support to the present shelf organizers based upon the weight of the products to be positioned thereon.

It is also recognized that the present shelf organizers can be utilized either on a flat supporting surface or on an inclined support structure for gravity feeding products therefrom. Also, importantly, it is further recognized and anticipated that the present shelf organizers will be utilized for converting a substantially flat shelf display area to a gravity feed orientation by simply assembling and positioning the present shelf organizers on the flat shelf display area and thereafter elevating the rear portion thereof so as to impart the desired inclination to the present shelf organizers for a gravity feed operation. Various means for accomplishing this gravity feed conversion are known in the industry. See, for example, U.S. Pat. No. 4,763,796. Still further, certain known types of shelving systems such as the ARDCO and ANTHONY load carrying rack systems are particularly adaptable for conversion to a gravity feed type operation by simply elevating the rear portion of the shelves associated with such systems to achieve a desired inclination such that when the present glide systems are positioned thereon, rows of products positioned on the present organizers will slide under the force of gravity towards the front portion of the unit.

The various components of the present glide system 10 are preferably constructed from a relatively rigid plastic material able to withstand moderate impact and mishandling without breakage and such components are likewise suitable for fabrication by either a thermo-forming process, an injection molding process or an extrusion process. It is also recognized that other various acceptable materials of construction are available and could likewise be employed to construct the various components of the present invention.

The present glide system therefore provides a user with a single system which is universally adjustable for use with a wide variety of product merchandising display units including units having open-grid type shelf structures associated therewith. In addition, the present glide system, as explained above, allows for a wide variety of configurations and this ability achieves flexible adaptation to any retail requirement and provides a convenient one-inventory solution to attractively arranging, organizing and cross-merchandising a wide variety of shelved products to consumers. The present organizer units comprise standardized and universal-type components which enable them to be assembled and arranged to achieve any desired product orientation as dictated by the particular needs of the individual users in the field. Use of the present system obviates the need for a merchant or other user to stock and use a wide variety of different shelf organizers in order to achieve the different product display configurations, all of which arrangements are achievable through use of the present system. The present system 10 enables a merchant to easily segregate any or all of the floor members into a plurality of parallel guide channels for supporting and guiding products positioned therebetween, each guide channel being selectively adjustable to accommodate any product width. This substantially increases the flexibility and use of such devices and provides the merchant with a greater range of possibilities for both maximizing shelf space and for cross-merchandising a wide variety of products therefrom.

Thus, there has been shown and described several embodiments of a universal floor/shelf organizer system for use in storing and merchandising shelved products therefrom, which devices fulfill all of the objects and advantages sought therefor. Many changes, modifications, variations, and other uses and applications of the preset constructions will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

The invention claimed is:

1. A floor member for displaying products thereon comprising:

a front wall portion, a rear portion, and a plurality of spaced apart track ribs extending substantially the full length therebetween, said plurality of track ribs defining a longitudinal slot between each two adjacent track ribs;

the outermost opposed track ribs forming the opposed side portions of said floor member, said outermost track ribs extending downwardly a distance greater than at least some of the other intermediate track ribs associated with said floor member;

cooperatively engageable joinder means associated with the opposed outermost track ribs for enabling said floor member to be cooperatively engaged in a side-by-side relationship with a similarly constructed floor member; and at least one frangible break-away portion associated with the rear portion of said floor member, said break-away portion having front and rear portions and including two offset spaced apart lines of weakness extending transversely across the front portion of said break-away portion between said opposed outermost track ribs for weakening said frangible break-away portion whereby said frangible portion can be broken along said two offset lines of weakness separating said frangible portion from the remainder of said floor member.

2. The floor member defined in claim 1 wherein one of said offset lines of weakness associated with said frangible break-away portion includes a line of weakness associated with the lower portion of at least the outermost track ribs and any other track ribs which extend downwardly a distance greater than the other remaining intermediate track ribs, and wherein the other of said offset lines of weakness associated with said frangible break-away portion includes a line of weakness associated with the lower portion of the remaining intermediate track ribs located above said first line of weakness.

3. The floor member defined in claim 1 wherein said front wall portion includes a plurality of slots positioned and located above said plurality of track ribs, and a removably attachable front wall stop member having means associated therewith for cooperatively engaging the slots associated with said front wall portion for holding said front wall stop member in engagement with said floor member.

4. The floor member defined in claim 3 wherein said front wall stop member further includes means for engaging said track ribs.

5. The floor member defined in claim 4 wherein said means for engaging said track ribs includes a pair of spaced apart hook members positioned and located for insertion within a corresponding pair of longitudinal track slots, said hook members being shaped and dimensioned for engaging said track ribs and restricting removal of said front wall stop member from said track slots but allowing said front wall stop member to be moved longitudinally within said respective track slots.

6. The floor member defined in claim 3 wherein said means for engaging the slots associated with said front wall portion includes a pair of spaced apart hook members, each hook member being cooperatively engageable with any one of the slots associated with said front wall portion.

7. The floor member defined in claim 3 wherein said front wall portion includes a graphic panel support member having a channel member located adjacent the bottom portion thereof, and wherein said removably attachable front wall stop member includes an overhanging lip portion having a channel member associated therewith, said overhanging lip portion extending at least partially over said graphic panel support member when said front wall stop member is engaged with said floor member such that said pair of channel members are in position for receiving a graphic panel member therebetween.

8. The floor member defined in claim 1 including a plurality of spaced apart transversely extending support members positioned between the front wall portion and rear portion of said floor member, at least some of said plurality of support members extending downwardly a distance greater than at least some of said track ribs, the bottom surfaces of said outermost track ribs, said front wall and rear portions, and at least some of said transverse support beams being co-planar with each other and forming the bottom edge surface of said floor member.

9. The floor member defined in claim 8 wherein the bottom surfaces of said outermost track ribs, said front wall and rear portions, and at least some of said transverse support members defining a plurality of segmented compartments, the bottom surfaces of said intermediate track ribs located within each segregated compartment being co-planar with each other.

10. The floor member defined in claim 1 including a separate floor extension member having cooperatively engageable means associated with one end portion thereof for engaging means associated with the rear end portion of the rearwardmost frangible break-away portion of said floor member so as to increase the overall length of said floor member.

11. The floor member defined in claim 10 wherein said floor extension member includes means associated with its opposite end portion for engaging a similarly constructed floor extension member so as to further increase the overall length of said floor member.

12. The floor member defined in claim 10 wherein said rearwardmost frangible break-away portion includes at least a pair of openings and a transverse member associated with the rear end portion thereof, the cooperatively engageable means associated with one end portion of said floor extension member including at least a pair of connection members positioned and located to engage a corresponding pair of openings associated with the rear end portion of said rearwardmost frangible break-away portion, and at least a pair of projections adapted to extend under the transverse member associated with the rear end portion of said rearwardmost frangible break-away portion.

13. The floor member defined in claim 12 wherein each of said at least pair of connection members includes at least one downwardly extending projection member which is sized and shaped to fit within the openings associated with the rear end portion of said rearwardmost frangible break-away portion.

14. The floor member defined in claim 1 wherein said cooperatively engageable joinder means associated with the opposed outermost track ribs includes a plurality of spaced apart L-shaped connector members associated with one of said outermost track ribs, each of said L-shaped connector members including an opening associated therewith, and a corresponding plurality of spaced apart transversely extending projection members associated with the other of said outermost track ribs, said transverse extending projection members being positioned within the longitudinal track slot defined between said outermost track rib and the adjacent intermediate track rib, the L-shaped connector members associated with one of said floor members being positionable within the longitudinal track slot located adjacent the other outermost track rib associated with a similarly constructed floor member, said plurality of transverse extending projection members associated with a similarly constructed floor member being receivable within the openings associated with the plurality of L-shaped connected members associated with the other floor member.

15. The floor member defined in claim 1 including at least one removably attachable divider member for selectively attaching to any one of said plurality of track ribs, said divider member including connector means extending downwardly therefrom for engaging with corresponding connector means associated with each respective track rib.

16. The floor member defined in claim 15 wherein the connector means associated with said at least one divider member includes a plurality of spaced apart downwardly extending connector members extending along at least a portion of the overall length of said divider member, one of said divider connector members including an opening extending at least partially therethrough, said remaining divider connector members including a pocket associated therewith, and wherein the connector means associated with each respective track rib includes a plurality of correspondingly spaced transverse projection members, each projection member being positioned between the top and bottom surfaces of each respective track rib and each projection member extending transversely across only a portion of the longitudinal slot existing between each respective pair of adjacent track ribs thereby forming a space between the terminal end portion of each respective track rib projection member and the track rib positioned adjacent thereto, said downwardly extending divider connector members being positionable within any one of said longitudinal track slots, one of said track rib projection members being cooperatively receivable within the opening associated with one of said divider connector members and the remaining track rib projection members being receivable within the pockets associated with the remaining divider connector members.

17. The floor member defined in claim 16 including a plurality of removably attachable divider members for selectively attaching to any one of said plurality of track ribs, said divider members forming a plurality of product channels for guiding and maintaining products positioned on said floor member, said divider members being adjustable along the width of said floor member for controlling and adjusting the width of each respective product channel.

18. The floor member defined in claim 15 wherein said at least one removably attachable divider member includes a front product stop member.

19. The floor member defined in claim 18 wherein the front wall portion of said floor member includes a plurality of slots positioned and located above said plurality of track ribs, and wherein the front product stop member associated with said at least one removably attachable divider member includes means for cooperatively engaging the slots associated with said front wall portion for additionally holding said divider member in engagement with said floor member.

20. The floor member defined in claim 19 wherein said means for engaging the slots associated with the front wall portion of said floor member includes a pair of spaced apart hook members, each hook member being cooperatively engageable with any one of the slots associated with said front wall portion.

21. The floor member defined in claim 18 wherein said front product stop member includes two separate non-colinear lines of weakness associated with the rear portion thereof for weakening said front product stop member whereby said front product stop member can be broken along said two separate lines of weakness separating said front product stop member from the remainder of said divider member.

22. The floor member defined in claim 18 wherein said front product stop member includes an overhanging lip portion having a channel member associated therewith extending along substantially the full length of said overhanging lip portion, and wherein the front wall portion of said floor member includes a graphic panel support member having a channel member located adjacent the bottom portion thereof, said overhanging lip portion extending at least partially over said graphic panel support member when said at least one divider member is attached to said floor member such that said pair of channel members are in position for receiving a graphic panel member therebetween.

23. The floor member defined in claim 18 wherein the front product stop member associated with said at least one divider member includes momentum arrestor means associated with the top portion thereof, said arrestor means functioning to stabilize the forwardmost product container positioned on said floor member when such forwardmost product container engages said front product stop member.

24. The floor member defined in claim 23 wherein said momentum arrestor means includes at least one projection member extending outwardly from the top portion of said front product stop member, said at least one projection member being positioned and located so as to contact a forwardmost product container positioned on said floor member adjacent one side of said divider member.

25. The floor member defined in claim 15 including at least one break-away portion associated with the rear portion of said at least one divider member for allowing adjustment of the overall length of said divider member so as to correspond to the length of said floor member, said at least one break-away rear divider portion including a line of weakness for severing said break-away portion from the remaining portion of said divider member.

26. The floor member defined in claim 25 including a plurality of break-away portions associated with the rear portion of said at least one divider member, each of said rear break-away portions including a line of weakness for severing said break-away portion from the remaining portion of said divider member.

27. The floor member defined in claim 25 wherein said at least one divider member includes a break-away rear stop member associated with the rearwardmost break-away divider portion, said rear stop member including at least one line of weakness for severing said rear stop member from said rearwordmost break-away divider portion.

28. The floor member defined in claim 27 wherein said break-away rear stop member includes a hook member, and wherein the respective end portions of each break-away divider portion and the end portion of the remaining non break-away divider portion includes a pair of spaced apart slots for receiving the hook member associated with said rear stop member.

29. The floor member defined in claim 28 wherein the hook portion associated with said rear stop member includes offset portions for engagement with said pair of spaced apart slots, said hook member further including a projection member associated with the terminal end portion thereof, said projection member being receivable within one of said pair of spaced apart slots.

30. The floor member defined in claim 15 wherein said at least one removably attachable divider member includes a rear stop member, said rear stop member including a channel portion engageable with the rear portion of said floor member.

31. A shelf organizer unit for merchandising products therefrom comprising:

a substantially flat product supporting floor member having a front wall portion, a rear portion, and a plurality of spaced track ribs extending substantially the full length therebetween, said plurality of track ribs defining a longitudinal slot between adjacent track ribs, the outermost opposed track ribs forming the opposed side portions of said floor member;

cooperatively engageable joinder means associated with the opposed outermost track ribs for enabling said floor member to be cooperatively engaged in side-by-side relationship with a similarly constructed floor member;

a plurality of spaced apart projection members extending along at least a portion of each respective track rib, each projection member being positioned between the top and bottom surfaces of each respective track rib and each projection member extending transversely across only a portion of the longitudinal slot existing between each respective pair of adjacent track ribs thereby forming a space between the terminal end portion of each respective transverse projection member and the track rib positioned adjacent thereto; and a plurality of removably attachable divider members for forming optional segregated product channels on said floor member for arranging products therebetween, each of said divider members including a plurality of downwardly extending spaced apart connection members extending along at least a portion thereof, one of said connection members associated with each divider member having an opening extending at least partially therethrough and the remaining connection members having a recess associated therewith;

the connector members associated with each divider member being selectively slidably receivable within any one of the longitudinal slots formed by and between each respective pair of track ribs, one of the projection members associated with each respective track rib being cooperatively receivable within the opening associated with one of said connector members associated with each respective divider member and the remaining projection members associated with each respective track rib being cooperatively receivable within the recesses associated with the remaining connector members associated with each divider member, the connector members associated with said divider members being slidably movable within the space formed by and between the terminal end portion of each respective transverse projection member and the adjacent track rib preparatory to engagement with said transverse projection members.

32. The shelf organizer unit defined in claim 31 wherein each of said plurality of divider members includes a front product stop member.

33. The shelf organizer unit defined in claim 32 wherein the front product stop member associated with each divider member includes two separate non-co-linear lines of weakness associated with the rear portion thereof for separating said front product stop member from the remainder of its corresponding divider member.

34. The shelf organizer unit defined in claim 32 wherein the front wall portion of said floor member includes a plurality of slots positioned and located above said plurality of track ribs, and wherein each of said front product stop members includes means for cooperatively engaging the slots associated with said front wall portion for additionally holding said divider member in engagement with said floor member.

35. The shelf organizer unit defined in claim 34 wherein said means for engaging the slots associated with the front wall portion of said floor member includes a pair of spaced apart hook members, each hook member being cooperatively engageable with any one of the slots associated with said front wall portion.

36. The shelf organizer unit defined in claim 32 wherein said front product stop member includes an overhanging lip portion having a channel member associated therewith, and wherein the front wall portion of said floor member includes a graphic panel support member having a channel member located adjacent one end portion thereof, said overhanging lip portion extending at least partially over said graphic panel support member when said divider members are attached to said floor member such that said pair of channel members are in position for receiving a graphic panel member therebetween.

37. The shelf organizer unit defined in claim 32 wherein each of said front product stop members includes momentum arrestor means associated with the top portion thereof, said arrestor means associated with a pair of divider members functioning to stabilize the forwardmost product container positioned within the product channel formed therebetween when said forwardmost product container engages said pair of front product stop members.

38. The shelf organizer unit defined in claim 37 wherein said momentum arrestor means includes at least one projection member extending outwardly from the top portion of each of said front product stop members, said at least one projection member being positioned and located so as to contact a forwardmost product container positioned within the product channel formed between adjacent divider members.

39. The shelf organizer unit defined in claim 31 including at least one frangible break-away portion associated with the rear portion of each of said divider members for allowing adjustment of the overall length of said divider members so as to correspond to the overall length of said floor member, said at least one frangible break-away rear divider portion including a line of weakness for severing said break-away rear portion from the remaining portion of each of said divider members.

40. The shelf organizer unit defined in claim 39 wherein each of said divider members includes a frangible break-away rear stop member associated with the rearwardmost frangible divider portion, said rear stop member including at least one line of weakness for severing said rear stop member from said rearwardmost frangible divider portion.

41. The shelf organizer unit in defined in claim 40 wherein said frangible rear stop member includes a hook member, and wherein the respective end portions of each frangible divider portion and the end portion of the remaining non-frangible divider portion of each divider member include a pair of spaced apart slots for receiving the hook member associated with said frangible rear stop member.

42. The shelf organizer unit defined in claim 31 wherein each of said divider members includes a rear stop member, said rear stop member including a channel portion engageable with the rear portion of said floor member.

43. The shelf organizer unit defined in claim 31 including a separate floor extension member having cooperatively engageable means associated with one end portion thereof for engaging corresponding means associated with the rear portion of said floor member so as to increase the overall length of said floor member.

44. The shelf organizer unit defined in claim 43 wherein said floor extension member includes means associated with its opposite end portion for engaging a similarly constructed floor extension member so as to further increase the overall length of said floor member.

45. The shelf organizer unit defined in claim 43 wherein the rear portion of said floor member includes at least a pair of openings and a transverse member associated therewith, the cooperatively engageable means associated with one end portion of said floor extension member including at least a pair of connection members positioned and located so as to engage the at least pair of openings associated with the rear portion of said floor member, and including at least a pair of projections adapted to extend under the transverse member associated with the rear end portion of said floor member.

46. The shelf organizer unit defined in claim 45 wherein each of said at least pair of connection members associated with said floor extension member includes at least one downwardly extending projection member which is sized and shaped within the openings associated with the rear end portion of said floor member.

47. The shelf organizer unit defined in claim 31 including at least one frangible break-away portion associated with the rear portion of said floor member for decreasing the overall length thereof.

48. The shelf organizer unit defined in claim 31 including a removably attachable front wail stop member having means associated therewith for cooperatively engaging the front wall portion of said floor member.

49. The shelf organizer unit defined in claim 48 wherein the means associated with the front wall portion of said floor member includes a plurality of slots positioned and located above said plurality of track ribs, and wherein the means associated with said removably attachable front wall stop member includes a pair of spaced apart hook members, each hook member being cooperatively engageable with any one of the slots associated with said front wall portion.

50. The shelf organizer unit defined in claim 48 wherein said removably attachable front wall stop member includes a pair of spaced apart hook members positioned and located for insertion within a corresponding pair of longitudinal track slots, said hook members being shaped and dimensioned for engaging said track ribs and resisting removal of said front wall product member from said longitudinal track slots.

51. A variable shelf organizer unit for merchandising products therefrom adaptable to accommodate varying shelf sizes and varying product dimensions, said shelf organizer unit comprising:

a floor member having a front wall portion, a rear portion, and a plurality of spaced apart track ribs extending substantially the full length therebetween, said plurality of track ribs defining a longitudinal slot between adjacent track ribs, the outermost opposed track ribs forming the opposed side portions of said floor member;

cooperatively engageable joinder means associated with the opposed outermost track ribs for enabling a plurality of similarly constructed floor members to be cooperatively engaged in side-by-side relationship with one another, the joinder means associated with one of said floor members being cooperatively engageable with the joinder means associated with another floor member positioned adjacent thereto;

at least one frangible break-away portion associated with the rear portion of said floor member, said break-away portion having front and rear portions and including two offset spaced apart lines of weakness extending transversely across the front portion of said break-away portion between said opposed outermost track ribs for weakening said break-away portion whereby said frangible floor portion can be broken along said offset lines of weakness separating said at least one frangible portion from the remainder of said floor member;

said floor member further including a plurality of transverse spaced apart projection members associated with each respective track rib, each transverse projection member being positioned and located between the top and bottom surfaces of each respective track rib and extending transversely across only a portion of the longitudinal slot existing between each respective pair of adjacent track ribs thereby forming a space between the terminal end portion of each respective transverse projection member and the track rib positioned adjacent thereto; and a plurality of removably attachable divider members for forming optional segregated product channels on said floor member for arranging products therebetween, each of said divider members including a plurality of downwardly extending connection members extending along at least a portion of the length thereof for selectively removably engaging each of said divider members with the transverse projection members associated with each of said track ribs so as to form segregated channels of variable width for arranging products therebetween;

the forwardmost connector member associated with each respective divider member including an opening extending therethrough and the remainder of said connector members associated with each respective divider member including a pocket associated therewith;

the connector members associated with each respective divider member being sized and shaped so as to be slidably receivable within each respective longitudinal track slot and within the space formed by and between the terminal end portion of each respective transverse floor projection member and the adjacent track rib, the forwardmost transverse floor projection member being cooperatively engageable with the opening associated with the forwardmost connection member associated with each respective divider member and the remaining transverse floor projection members being cooperatively receivable within the pockets associated with the remaining connection members associated with each respective divider member;

each of said divider members including a frangible break-away front product stop member and at least one frangible break-away portion associated with the rear portion of each respective divider member.

52. The variable shelf organizer unit defined in claim 51 wherein the front wall portion of said floor member includes a graphic panel support member having a channel member located adjacent the bottom portion thereof, and wherein the frangible break-away front product stop member associated with each of said divider members includes an overhanging lip portion having a channel member associated therewith, said overhanging lip portion extending at least partially over said graphic panel support member when said divider members are engaged with said track ribs such that said pair of channel members are in position for receiving a graphic panel member therebetween.

* * * * *